US011952757B2

(12) United States Patent
Zhou

(10) Patent No.: US 11,952,757 B2
(45) Date of Patent: Apr. 9, 2024

(54) WATER OUTLET DEVICE

(71) Applicants: Xiamen Water Nymph Sanitary Technology Co., Ltd., Xiamen (CN); Huaqiang Zhou, Xiamen (CN)

(72) Inventor: Huaqiang Zhou, Xiamen (CN)

(73) Assignees: Xiamen Water Nymph Sanitary Technology Co., Ltd., Xiamen (CN); Huaqiang Zhou, Xiamen (CN)

( * ) Notice: Subject to any disclaimer, the term of this patent is extended or adjusted under 35 U.S.C. 154(b) by 222 days.

(21) Appl. No.: 17/162,963

(22) Filed: Jan. 29, 2021

(65) Prior Publication Data

US 2021/0148100 A1 May 20, 2021

(30) Foreign Application Priority Data

Jul. 7, 2020 (CN) ..... 202010646694.1

(51) Int. Cl.
*E03C 1/04* (2006.01)
*E03C 1/084* (2006.01)
*E03C 1/086* (2006.01)

(52) U.S. Cl.
CPC ..... *E03C 1/0405* (2013.01); *E03C 1/084* (2013.01); *E03C 1/086* (2013.01)

(58) Field of Classification Search
CPC ..... E03C 1/04045; E03C 1/084; E03C 1/086; E03C 2001/026; B05B 1/12; B05B 1/3006; B05B 1/3033; B05B 1/1609
See application file for complete search history.

(56) References Cited

U.S. PATENT DOCUMENTS 8,151,826 B2 * 4/2012 Dan ..... E03C 1/08 222/511
9,205,436 B2 * 12/2015 Zhou ..... B05B 1/1636
2008/0251604 A1 * 10/2008 Schmid ..... E03C 1/084 239/113
2014/0217203 A1 * 8/2014 Zoller ..... E03C 1/084 239/428.5

FOREIGN PATENT DOCUMENTS

CN 104874506 * 9/2015 ..... B05B 1/12

* cited by examiner

*Primary Examiner* — Christopher R Dandridge
(74) *Attorney, Agent, or Firm* — Westbridge IP LLC

(57) ABSTRACT

A water outlet device comprises a water inlet mechanism, a diversion mechanism, and a guide mechanism rotatably connected to the water inlet mechanism. The diversion mechanism is disposed in the water inlet mechanism and penetrates through the axis of the guide mechanism. The water inlet mechanism comprises a water inlet channel. The diversion mechanism comprises a first water outlet channel. The guide mechanism comprises a second water outlet channel and a third water outlet channel. When the guide mechanism moves with respect to the diversion mechanism, the water inlet channel is communicated with the first water outlet channel, the second water outlet channel or the third water outlet channel. The water outlet device can realize switching of multiple water forms to discharge three types of functional water in a limited space and has a small size and rich functions.

13 Claims, 29 Drawing Sheets

WATER OUTLET DEVICE

CROSS-REFERENCE TO RELATED APPLICATIONS

The application claims priority to Chinese patent application CN 202010646694.1, filed on Jul. 7, 2020, the entire contents of which are incorporated herein by reference.

TECHNICAL FIELD

The invention relates to the field of bath products, in particular to a water outlet device.

BACKGROUND

At present, to change the water outlet manner of a faucet, a water outlet device is generally arranged under the faucet to control or regulate the outlet flow and outlet state of the faucet.

To keep the outer diameter of the water outer device consistent with the outer diameter of the faucet, the applicant has applied for the following patents:

A water outlet control device (Patent Publication No. CN104874506B) discloses a water diversion body and a water guide body, wherein the water diversion body comprises a guide hole penetrating through the water diversion body; the water guide body comprises a first water inlet, a second water inlet, a first water outlet channel and a second water outlet channel, the first water inlet is communicated with an upper space of the second water inlet and is communicated with the first water outlet channel and the second water outlet channel, the second water inlet is communicated with the first water outlet channel, and a water outlet of the first water outlet channel surrounds a water outlet of the second water outlet channel; the water diversion body is rotatably connected to the water guide body, the guide hole is communicated with the first water inlet or the second water inlet when the water diversion body rotates with respect to the water guide body, and the upper space is defined by the water outlet end of the guide hole and the space between the first water inlet and the second water inlet.

In the above patent, the guide hole is switched to the first water inlet or the second water inlet through the planar rotation of the water diversion body with respect to the water guide body, and the first water outlet channel and the second water outlet channel of the water guide body respectively discharge one type of functional water, so the water outlet control device in this patent can realize the switching of two types of functional water.

The water outlet control device in this patent is small in size, but it can discharge only two types of functional water and thus cannot satisfy more requirements of users.

There are devices that can discharge multiple types of functional water on the present market such as showers. Existing showers typically have three different water outlet manners and realize switching of multiple water passages by means of planar rotation of parts. During actual research and development, to make the showers small enough to be applied to faucets, the outer diameter of the showers can only be reduced to 40 mm, which mismatches the size of the faucets. Thus, it will be a great challenge to realize switching of multiple types of functional water within a limited space.

SUMMARY

The technical issue to be settled by the invention is to provide a water outlet device to solve the problems that existing water outlet devices can discharge only a few types of functional water.

To settle the aforesaid technical issue, the technical solution adopted by the invention is as follows:

A water outlet device comprises a water inlet mechanism, a diversion mechanism, and a guide mechanism rotatably connected to the water inlet mechanism.

The diversion mechanism is disposed in the water inlet mechanism and penetrates through the axis of the guide mechanism.

The water inlet mechanism comprises a water inlet channel.

The diversion mechanism comprises a first water outlet channel.

The guide mechanism comprises a second water outlet channel and a third water outlet channel.

When the guide mechanism moves with respect to the diversion mechanism, the water inlet channel is communicated with the first water outlet channel, the second water outlet channel or the third water outlet channel.

The invention has the following beneficial effects: the diversion mechanism is arranged to realize different water outlet manners in the moving process of the guide mechanism and is additionally provided with the first water outlet channel within a limited space, so that compared with the prior art, one type of functional water is added without increasing the overall size of the water outlet device. When the water inlet channel is communicated with the first water outlet channel, a first type of functional water can be formed. When the water inlet channel is communicated with the second water outlet channel, a second type of functional water can be formed. When the water inlet channel is communicated with the third water outlet channel, a third type of functional water can be formed. These three types of functional water are suitable for different application scenarios to make it possible to use faucets or other bath products as multifunctional water outlet devices to meet daily requirements of users. Compared with the prior art, the water outlet device of the invention is simple in structure, occupies a small space, additionally realizes one type of functional water without increasing the occupied space, can switch different water outlet manners, and has higher practical value.

DETAILED DESCRIPTION OF THE EMBODIMENTS

Figure 1:
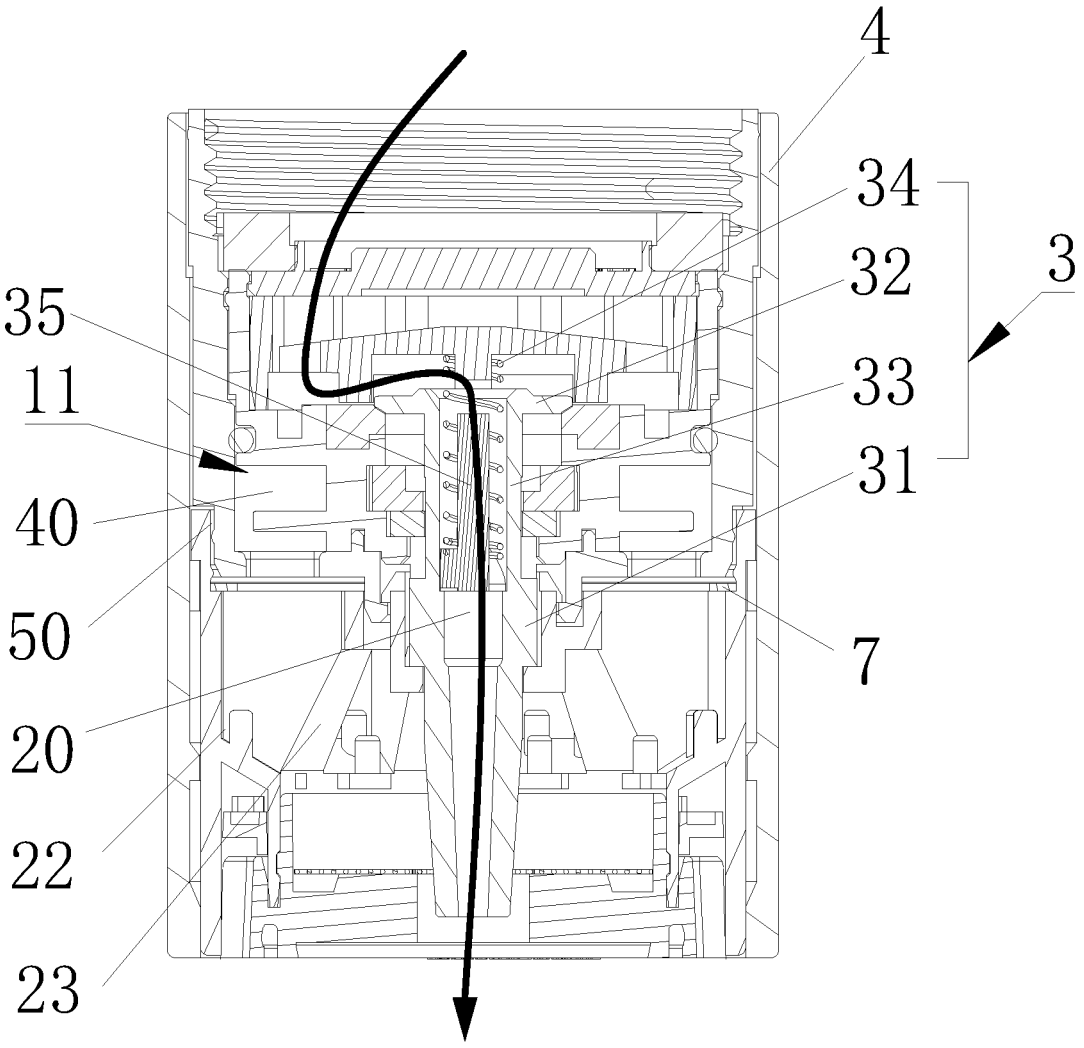
FIG. 1 is a sectional view of a water outlet device capable of discharging water mist in Embodiment 1 of the invention.

The technical contents, purposes and effects of the invention will be expounded below in conjunction with the implementations and accompanying drawings.

Referring to FIG. 1-FIG. 9, a water outlet device comprises a water inlet mechanism, a guide mechanism connected to the water inlet mechanism, and a diversion mechanism arranged in the water inlet mechanism and penetrating through the guide mechanism.

The water inlet mechanism comprises a water inlet channel.

The diversion mechanism comprises a first water outlet channel.

The guide mechanism comprises a second water outlet channel and a third water outlet channel.

When the guide mechanism moves with respect to the diversion mechanism, the water inlet channel is communicated with the first water outlet channel, the second water outlet channel or the third water outlet channel.

The operating principle of the invention is as follows:

The diversion mechanism penetrates through the axis of the guide mechanism, so that one type of functional water is added without increasing the size of the water outlet device.

When the diversion mechanism is located at the bottom of a movement space in the water inlet mechanism, the water inlet channel is communicated with the first water outlet channel to form a first type of functional water.

When the diversion mechanism is located at the top of the movement space in the water inlet mechanism, the water inlet channel is communicated with the second or third water outlet channel to form a second type of function water or a third type of functional water.

From the above description, the invention has the following beneficial effects: the diversion mechanism is arranged to realize different water outlet manners in the moving process of the guide mechanism and is additionally provided with the first water outlet channel within a limited space, so that compared with the prior art, one type of functional water is added without increasing the overall size of the water outlet device. When the water inlet channel is communicated with the first water outlet channel, the first type of functional water can be formed. When the water inlet channel is communicated with the second water outlet channel, the second type of functional water can be formed. When the water inlet channel is communicated with the third water outlet channel, the third type of functional water can be formed. These three types of functional water are suitable for different application scenarios to make it possible to use faucets or other bath products as multifunctional water outlet devices to meet daily requirements of users. Compared with the prior art, the water outlet device of the invention is simple in structure, occupies a small space, additionally realizes one type of functional water without increasing the occupied space, can switch different water outlet manners, and has higher practical value.

Furthermore, the guide mechanism and the diversion mechanism are able to move with respect to the water inlet mechanism; and when the guide mechanism and the diversion mechanism move with respect to the water inlet mechanism, the water inlet channel is communicated with the first water outlet channel, the second water outlet channel or the third water outlet channel.

From the above description, when the guide mechanism and the diversion mechanism simultaneously move with respect to the water inlet mechanism, the water inlet channel is communicated with the first water outlet channel, the second water outlet channel or the third water outlet channel to realize switching of three types of functional water in another manner.

Furthermore, when the guide mechanism moves with respect to the water inlet mechanism, the water inlet channel is communicated with the first water outlet channel or the second water outlet channel, or is communicated with the first water outlet channel and the third water outlet channel.

From the above description, when the guide mechanism moves with respect to the water inlet mechanism, the water inlet channel may be communicated with the first water outlet channel, the second water outlet channel and the third water outlet channel in three manners to realize switching of three types of functional water, so that water outlet manners of a faucet are enriched.

Furthermore, the diversion mechanism comprises a water outlet; and when the guide mechanism rotates with respect to the diversion mechanism, the water inlet channel is communicated with the second water outlet channel or the third water outlet channel via the water outlet.

From the above description, the water outlet hole is formed to realize secondary water diversion in the water inlet channel when the guide mechanism rotates with respect to the diversion mechanism. Primary water diversion is realized in the water inlet channel through the diversion mechanism; when the first water outlet channel is closed, water flows into the second water outlet channel or the third water outlet channel from the water inlet mechanism via the water outlet, so that a second type of functional water and a third type of functional water is discharged.

Furthermore, a mounting hole is formed in the guide mechanism.

A step is mounted on the mounting hole.

The diversion mechanism penetrates through the mounting hole and rotatably abuts against the step.

Furthermore, the step comprises a first step surface and a second step surface.

The first step surface is in transitional connection with the second step surface through a slope.

Furthermore, a protrusion is arranged at an end, located in the guide mechanism, of the diversion mechanism and moves vertically along the step in the rotating process of the guide mechanism.

From the above description, the mounting hole is formed in the guide mechanism, and the diversion mechanism penetrates through the mounting hole to be supported; the step comprising the first step surface and the second step surface is disposed on the mounting hole to allow the protrusion to move along the first step surface and the second step surface, so that the position of the diversion mechanism in the water inlet mechanism can be changed to realize switching of different types of functional water, the first step surface and the second step surface are in transitional connection through a slope, so that the protrusion can smoothly move on the first step surface and the second step surface; moreover, the diversion mechanism can vertically move automatically under the direct effect of the guide mechanism to make the transmission between the diversion mechanism and the guide mechanism more reliable, the stability is better, the diversion mechanism can be positioned more accurately, the number of components is reduced, and the space occupied by the components is reduced.

Furthermore, the upper end of the protrusion is inserted into the water inlet mechanism.

From the above description, the protrusion is inserted into the water inlet mechanism, so that the relative positional relation between the diversion mechanism and the water inlet mechanism can be kept stable, the guide mechanism can rotate with respect to the diversion mechanism and the water inlet mechanism, transmission is more stable, and different water outlet channels can be switched stably.

Furthermore, a barrier for blocking the second water outlet channel is arranged at an end, located in the water inlet mechanism, of the diversion mechanism.

From the above description, when the diversion mechanism is located at the bottom of the movement space of the water inlet mechanism, the barrier can block the second water outlet channel to meet the condition for discharging the first type of functional water.

Furthermore, the diversion mechanism comprises a diversion body and a reset member.

One end of the reset member is arranged in the diversion body, and the other end of the reset member abuts against one side of the water inlet mechanism.

From the above description, the diversion body and the reset member are arranged to push the diversion body to change the spatial position in the water inlet mechanism, so that rotational switching of multiple types of functional water is realized.

Furthermore, a functional part is disposed in the diversion body.

One end of the reset member presses against the functional part, and the other end of the reset member abuts against one side of the water inlet mechanism.

From the above description, the functional part is disposed in the diversion body and can be changed according to actual using requirements, so that when water flows out of the diversion body, special flow patterns such as water mist can be formed under the effect of the functional part.

Furthermore, the water inlet mechanism comprises a water inlet assembly and a water outlet assembly.

One end of the diversion mechanism is movably disposed in the water inlet assembly, and the other end of the diversion mechanism movably penetrates through the water outlet assembly.

A transitional passage for communicating the water inlet channel with the second water outlet channel is formed between the water inlet assembly and the water outlet assembly.

From the above description, the water inlet channel and the second water outlet channel are communicated through the transitional passage.

Furthermore, the guide mechanism is connected to the water outlet assembly in a buckled manner.

From the above description, the guide mechanism is connected to the water outlet assembly in the buckled manner, so that the guide mechanism can move stably with respect to the water outlet assembly.

Furthermore, the water outlet device further comprises a shell.

The shell is disposed outside the water outlet assembly and the guide mechanism.

A water inlet gap is formed between the water outlet assembly and the shell.

The air inlet gap is communicated with the second water outlet channel.

From the above description, the air inlet gap is formed between the shell and the water outlet assembly and is communicated with the second water outlet channel, air is absorbed by water from the air inlet gap according the Bernoulli principle and the Venturi effect and is mixed with water in the second water outlet channel to form aerated water or shower water, so that the impact force generated when water is sprayed to the surface of the skin of users is reduced, and discomfort caused by water impact to the users is reduced.

The water outlet device of the invention can be applied to kitchen faucets, bathroom faucets, showers, bidets or the like.

Embodiment 1 of the invention is as follows:

This embodiment provides a kitchen faucet provided with an external thread or a bathroom faucet provided with an external thread.

Referring to FIG. 1 to FIG. 7, a water outlet device comprises a water inlet mechanism 1, a guide mechanism 2 connected to the water inlet mechanism 1, and a diversion mechanism 3 disposed in the water inlet mechanism 1 and penetrating through the guide mechanism 2.

The water inlet mechanism 1 comprises a water inlet channel 10.

The diversion mechanism 3 comprises a first water outlet channel 20.

The guide mechanism 2 comprises a second water outlet channel 301 and a third water outlet channel 302.

When the guide mechanism 2 moves with respect to the diversion mechanism 3, the water inlet channel 10 is communicated with the first water outlet channel 20, the second water outlet channel 301 or the third water outlet channel 302.

Figure 8:
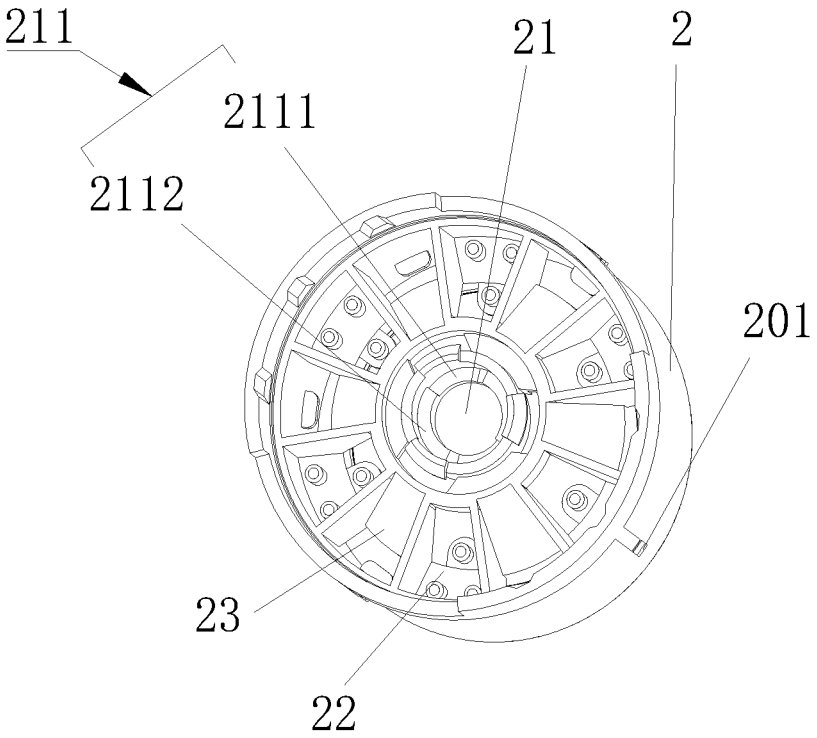
FIG. 8 is a structural view of a guide mechanism in Embodiment of the invention.

Referring to FIG. 8, a mounting hole 21 is formed in the guide mechanism 2.

A step 211 is arranged on the mounting hole 21.

The diversion mechanism 3 penetrates through the mounting hole 21 and rotatably abuts against the step 211.

Preferably, two steps 211 are symmetrically arranged on the mounting hole 21.

Preferably, the step 211 comprises a first step surface 2111 and a second step surface 2112, the first step surface 2111 and the second step surface 2112 are sequentially arranged in an encircling manner from bottom to top, the first step surface 2111 and the second step surface 2112 are connected through a transitional slope, the second step 2112 and another first step surface 2111 are connected through a transition slop, and another second step surface 2112 and the first step surface 2111 are connected through a first transitional slope;

Referring to FIG. 1, a protrusion 31 is arranged at an end, located in the guide mechanism 2, of the diversion mechanism 3 and is able to move vertically along the step 211, and an upper end of the protrusion 31 is inserted into the water inlet mechanism 1.

Preferably, two protrusions 31 are symmetrically arranged on the outer wall of the diversion mechanism 3.

Referring to FIG. 1, a barrier 32 for blocking the second water outlet channel 301 and the third water outlet channel 302 is arranged at an end, located in the water inlet mechanism 1, of the diversion mechanism 3.

Referring to FIG. 1, the diversion mechanism 3 comprises a diversion body 33 and a reset member 34, one end of the reset member 34 is disposed in the diversion body 33, and the other end of the reset member 34 abuts against one side of the water inlet mechanism 1. Preferably, the protrusion 31, the barrier 32 and the diversion body 33 are formed integrally. Preferably, the reset member 34 is a compression spring.

Figure 23:
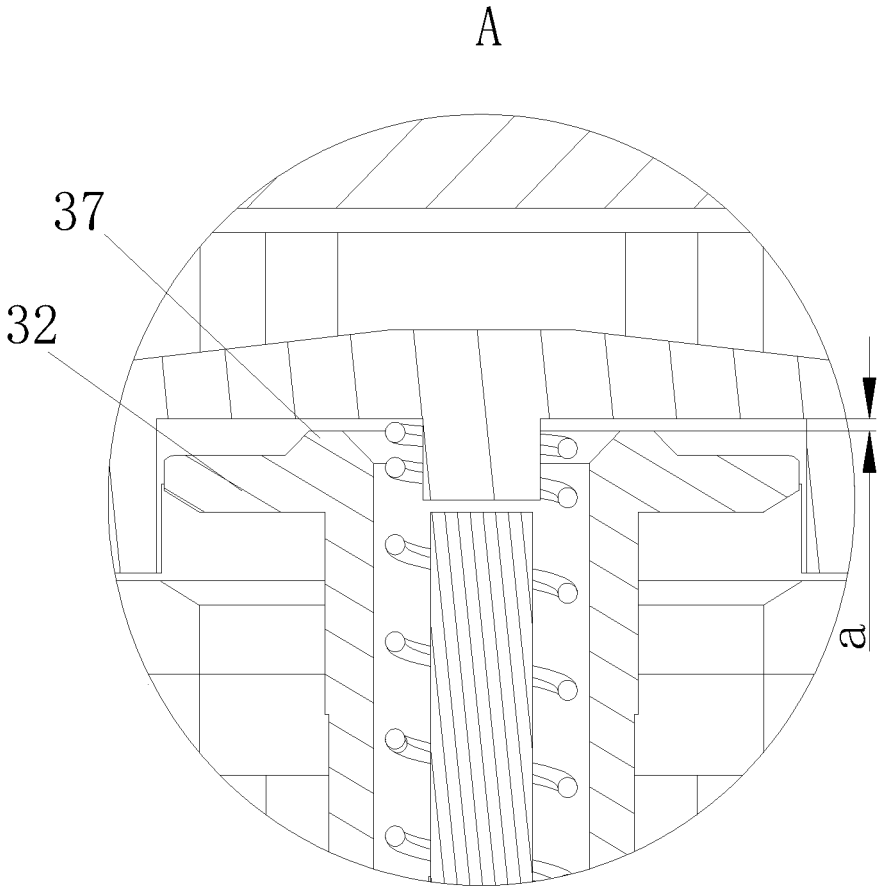
FIG. 23 is an enlarged view of part A in FIG. 22.
Figure 24:
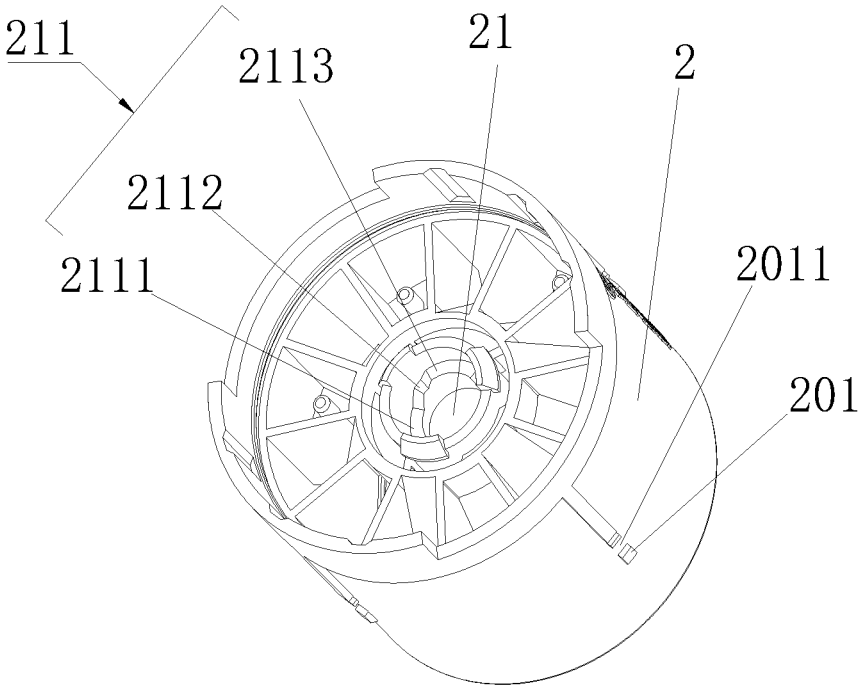
FIG. 24 is a structural view of a guide mechanism in Embodiment 6 of the invention.

Referring to FIG. 23, a first annular boss 37 is disposed at the top of the barrier 32, the first barrier 32 is located outside the first annular boss 37, the distance between the barrier 32 and the water inlet mechanism 1 is greater than the distance between the first annular boss 37 and the water inlet mechanism 1, the area of a side, facing the water inlet mechanism 1, of the first annular boss 37 is smaller than the area of a side, facing the water inlet mechanism 1, of the barrier 32, and the area of a side, facing the water inlet mechanism, of the barrier 32 is smaller than the area of a side, facing the guide mechanism 2, of the barrier 32, so that the water pressure between the water inlet mechanism 1 and the barrier 32 and the thrust of the reset member 34 can overcome the water pressure below the barrier 32 to push the diversion body 33 to move downwards.

Referring to FIG. 1, a functional part 35 is disposed in the diversion body 33, one end of the reset member 34 abuts against the functional part 35, and the other end of the reset member 34 abuts against one side of the water inlet mechanism 1.

Figure 3:
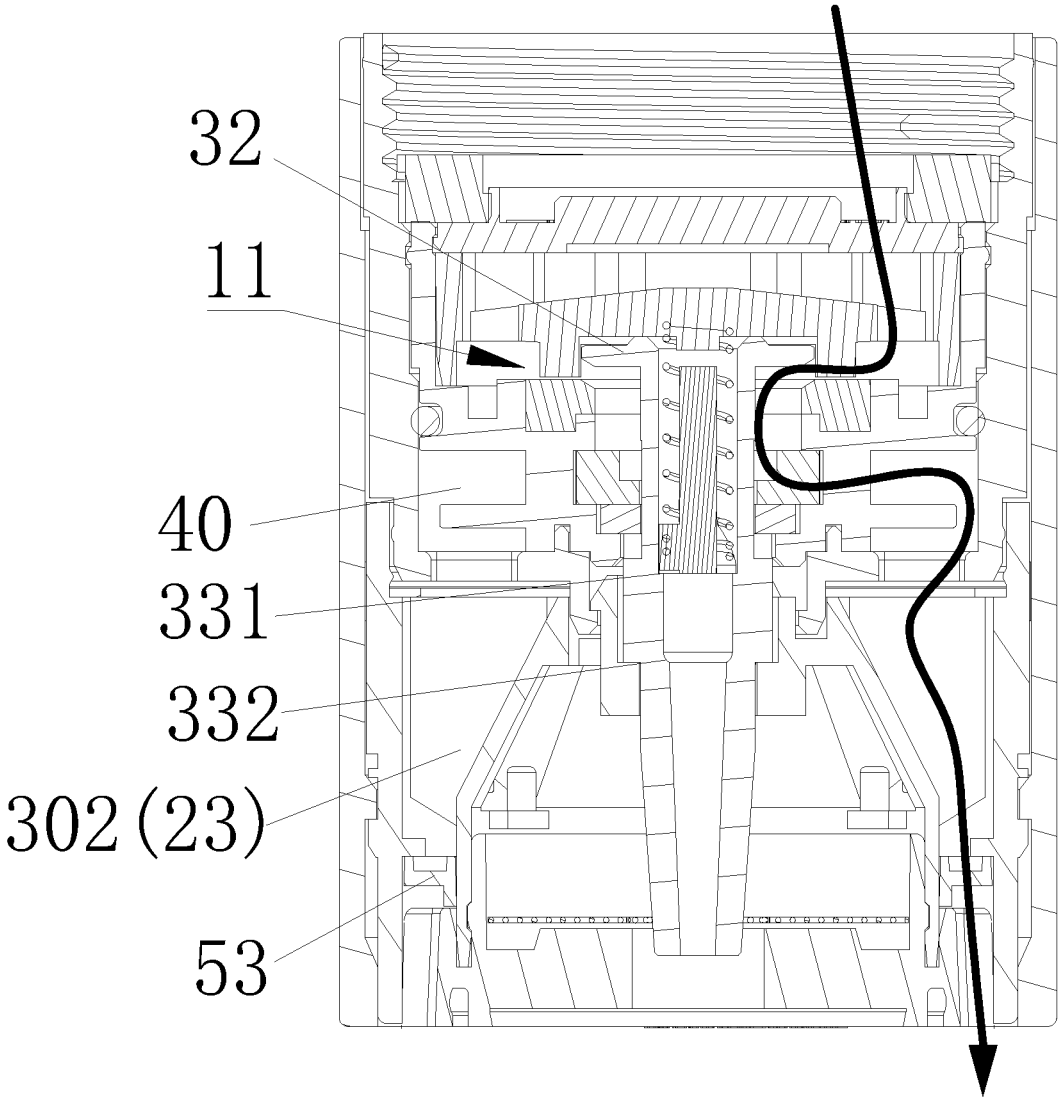
FIG. 3 is a sectional view of the water outlet device capable of discharging shower water in Embodiment 1 of the invention.

Specifically, referring to FIG. 3, a first annular step 331 and a second annular step 332 are arranged in the diversion body 33 and are sequentially arranged from top to bottom, the diameter of the first annular step 331 is greater than that of the second annular step 332, the lower end of the functional part 35 abuts against the first annular step 331, and a water outlet of the diversion body 33 is circular and can spray columnar water mist.

Figure 2:
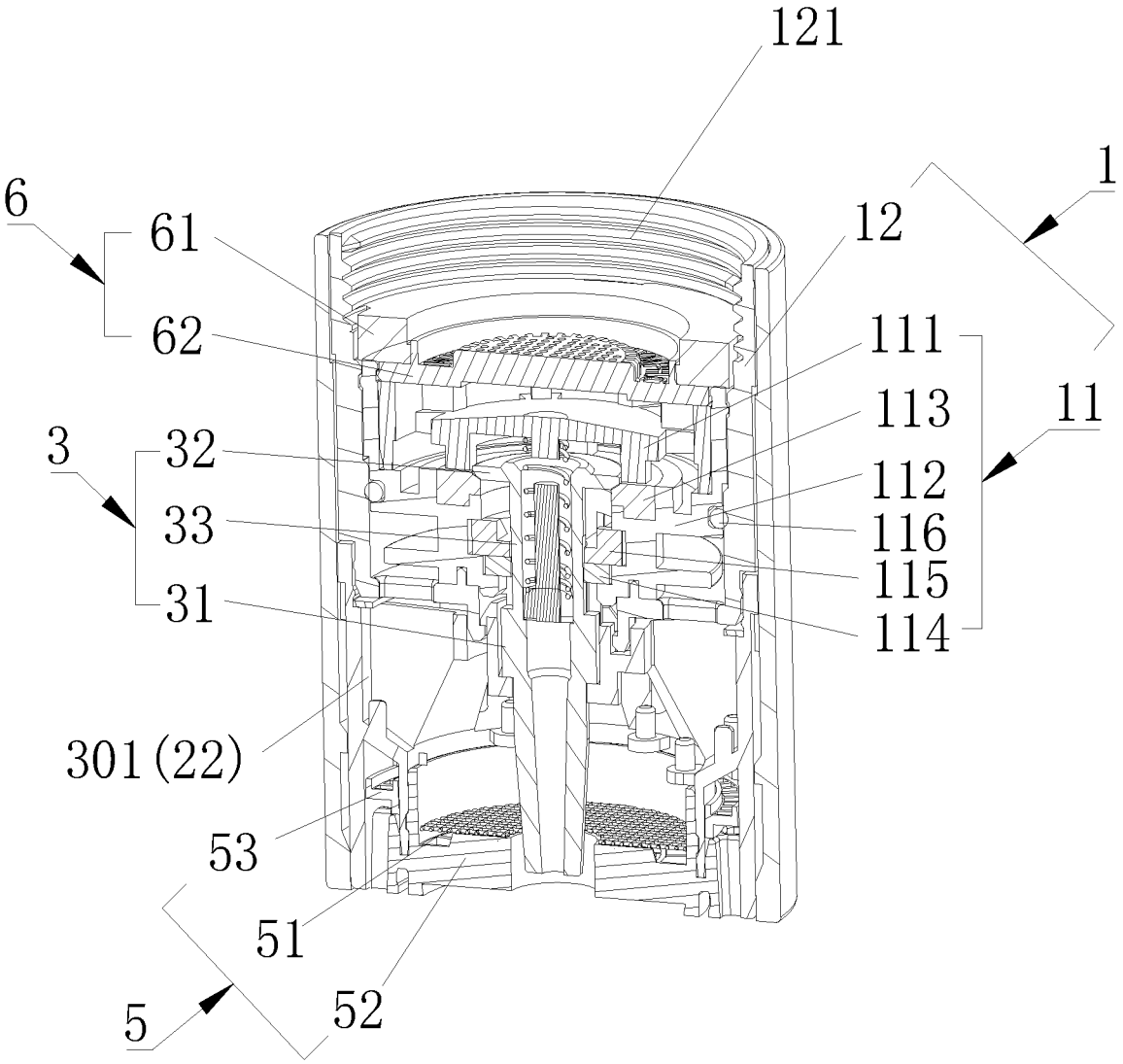
FIG. 2 is a perspective sectional view of the water outlet device capable of discharging water mist in Embodiment 1 of the invention.

Referring to FIG. 1 and FIG. 2, the water inlet mechanism 1 comprises a water inlet assembly 11 and a water outlet assembly 12, one end of the diversion mechanism 3 is movably disposed in the water inlet assembly 11, the other end of the diversion mechanism 3 movably penetrates through the water outlet assembly 12, and a transitional passage 40 for communicating the water inlet channel 10 with the second water outlet channel 301 or for communicating the water inlet channel 10 with the third water outlet channel 302 is formed between the water inlet assembly 11 and the water outlet assembly 12; and the guide mechanism 2 is connected to the water outlet assembly 12 in a buckled manner.

Specifically, the water outlet assembly 12 comprises a water outlet body 122, an internal thread 121 to be connected to a faucet is arranged at the top of the water outlet body 122, a concave accommodating cavity 1221 for accommodating a gear assembly is formed in the outer wall of the water outlet body 122, a plurality of water outlets 1222 for communicating the water inlet channel 10 with the second water outlet channel 301 or for communicating the water inlet channel 10 with the third water outlet channel 302 are formed in the bottom of the water outlet body 122, and the water outlet body 122 and the water inlet assembly 11 are limited by the accommodating cavity 1221; and the gear assembly in the accommodating cavity 1221 comprises a spring and a pin roller, the pin roller is pushed by the spring to slidably abut against different limiting grooves in the inner wall of the top of the water outlet body 122, each limiting groove corresponds to one water outlet state, and the gear can be shifted when the guide mechanism 2 rotates with respect to the water inlet mechanism 1.

Referring to FIG. 1, the water outlet device further comprises a shell 4, the shell 4 is disposed outside the water outlet assembly 12 and the guide mechanism 2, and an air inlet gap 50 is formed between the water outlet assembly 12 and the shell 4; a plurality of bumps are regularly arranged at each of upper and lower ends of the outer wall of the water outlet assembly 12 and are used to reserve gaps between the water outlet assembly 12 and the shell 4 as well as between the water outlet assembly 12 and the guide mechanism 2 to keep the air inlet gap 50 unblocked; and the air inlet gap 50 is communicated with the second water outlet channel 301, and a metal gasket 7 for increasing the inlet air intensity is disposed between the guide mechanism 2 and the water outlet assembly 12.

Specifically, the guide mechanism 2 is rotatably clamped and connected to the water outlet assembly 12; the guide mechanism 2 is connected to the shell 4 through buckles, that is, a male buckle 201 on the outer surface of the guide mechanism 2 is clamped in a female buckle 401 on the inner wall of the shell 4, an upper limiting step 41 and a lower limiting step 42 are arranged on the inner wall of the shell 4, the female buckle 401 is arranged on the side wall of the upper limiting step 41, a limiting groove 2011 matched with the lower limiting step 42 is formed in the male buckle 201 on the outer side of the guide mechanism 2, the male buckle 201 is inserted into the female buckle 401 and further moves downwards until the lower limiting step 42 is embedded in the limiting groove 2011, and the upper end of the male buckle 201 is limited in the female buckle 401, so that the guide mechanism 2 can rotate along with the shell 4.

Referring to FIG. 1 and FIG. 8, a first water inlet cavity 22 and a second water inlet cavity 23 are formed in the guide mechanism 2 and are adjacent to each other.

Referring to FIG. 2, the water outlet device further comprises a filter assembly 5 and a pressurization assembly 6, the filter assembly 5 is disposed on the lower side of the guide mechanism 2 and is communicated with the second water outlet channel 301. The filter assembly 5 comprises a lower filter screen 51, a first water outlet ring 52 and a second water outlet ring 53, the second water outlet ring 53 is disposed around the first water outlet ring 52; the lower filter screen 51 is embedded in the first water outlet ring 52, and the first water outlet ring 52 is inserted into the water outlet of the guide mechanism 2; and the first water outlet ring 52 is clamped and connected to the guide mechanism 2.

Specifically, the second water outlet channel 301 is communicated with the first water outlet ring 52, and the third water outlet channel 302 is communicated with the second water outlet ring 53. The water outlet assembly 12 comprises a water outlet body 122, and a plurality of water outlets 1222 for communicating the water inlet channel 10 with the second water outlet channel 301 or for communicating the water inlet channel 10 with the third water outlet channel 302 are formed in the bottom of the water outlet body 122. The pressurization assembly 6 comprises a first washer 61 and an upper filter screen 62, the first washer 61 and the upper filter screen 62 are sequentially disposed at the top of the water inlet assembly 11.

The implementation process of this embodiment is as follows:

Referring to FIG. 1 and FIG. 2, when the protrusion 31 abuts against the first step surface 2111, the bottom of the barrier 32 abuts against the water inlet assembly 11, the transitional passage 40 is closed, and the water inlet assembly 10 is communicated with the first water outlet channel 20, and water mist or columnar water in other forms can be formed according to the actual function of the functional part 35. In this embodiment, the functional part 35 can form water mist.

Figure 4:
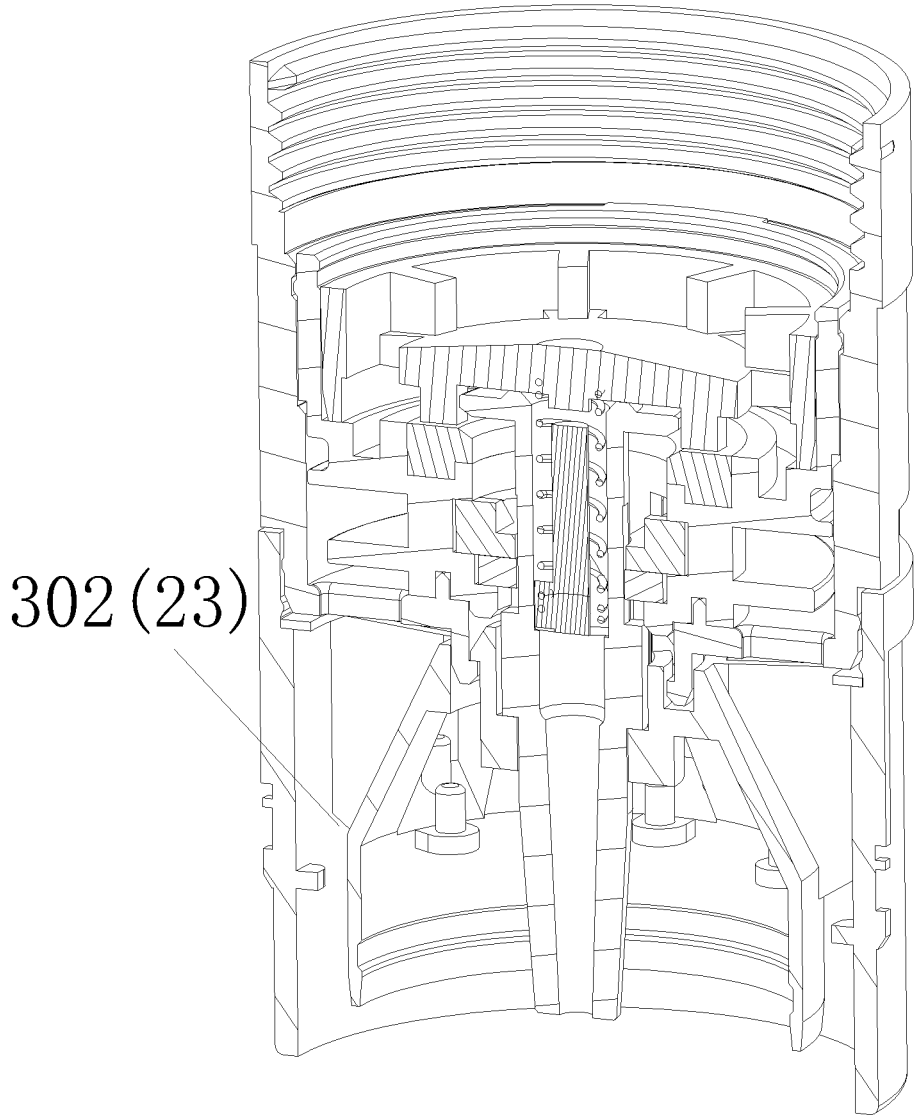
FIG. 4 is a perspective sectional view of the water outlet device capable of discharging shower water in Embodiment 1 of the invention.

Referring to FIG. 3 and FIG. 4, the shell 4 is rotated to drive the guide mechanism 2 to rotate to enable the protrusion 31 to abut against the second step surface 2112, at this moment, the top of the diversion body 33 abuts against the top of the inner side of the water inlet assembly 11, the first water outlet channel 20 is closed, and the water inlet channel 10 is communicated with the transition channel 40 and the third water outlet channel 302 to discharge shower water.

Figure 5:
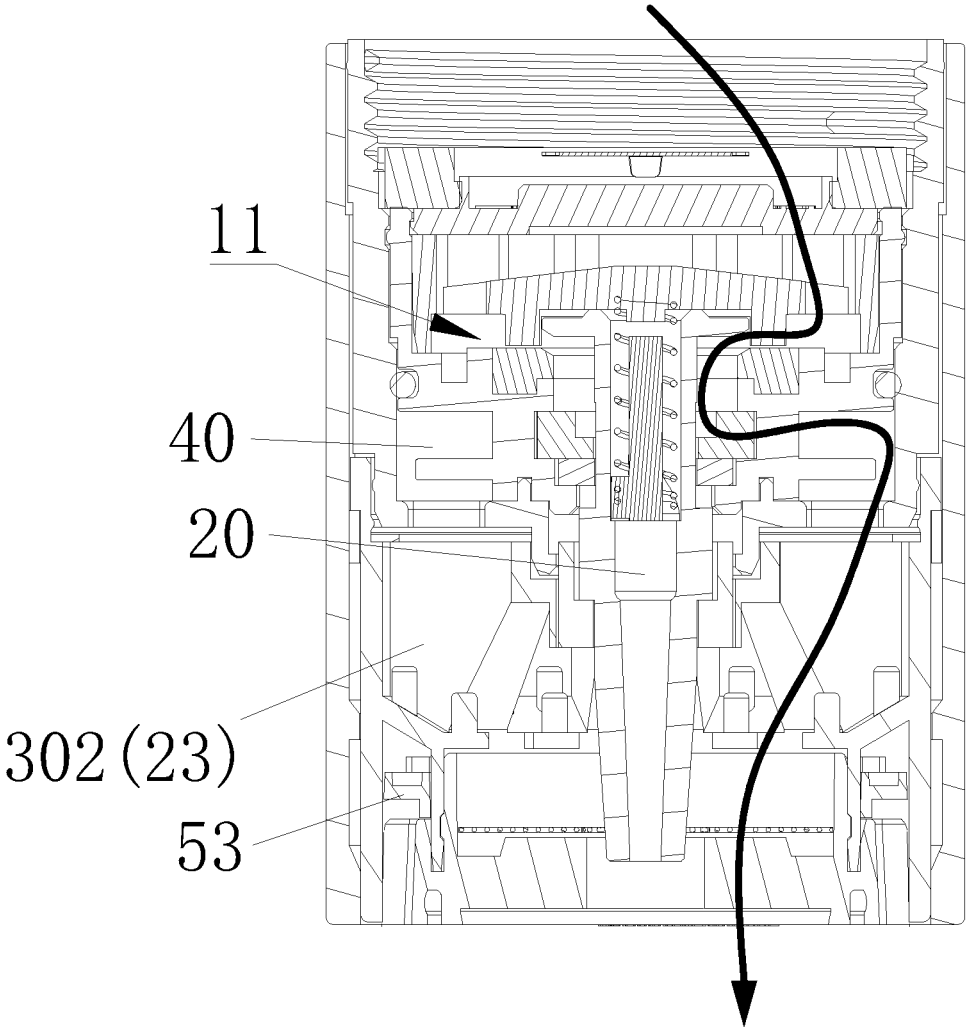
FIG. 5 is a sectional view of the water outlet device capable of discharging aerated water in Embodiment 1 of the invention.
Figure 6:
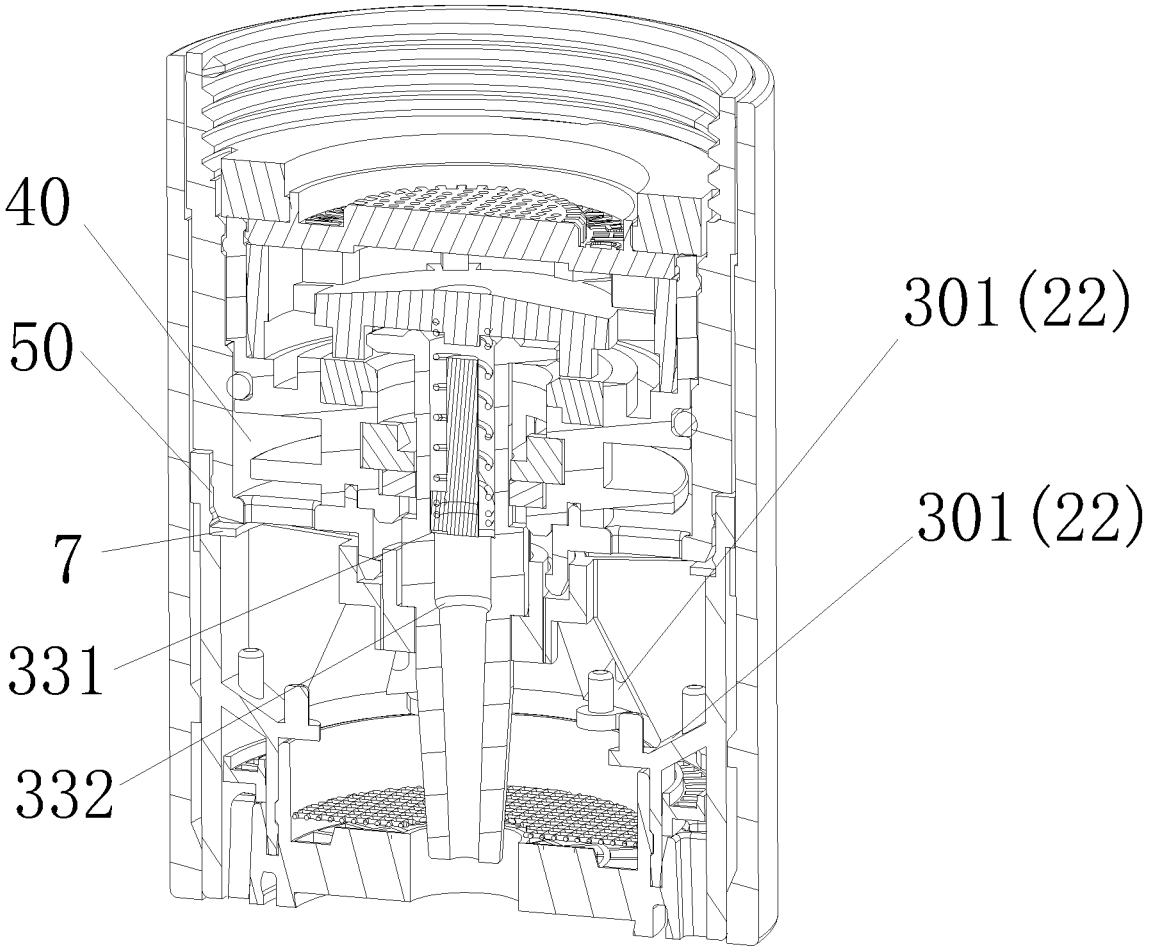
FIG. 6 is a perspective sectional view of the water outlet device capable of discharging aerated water in Embodiment 1 of the invention.
Figure 7:
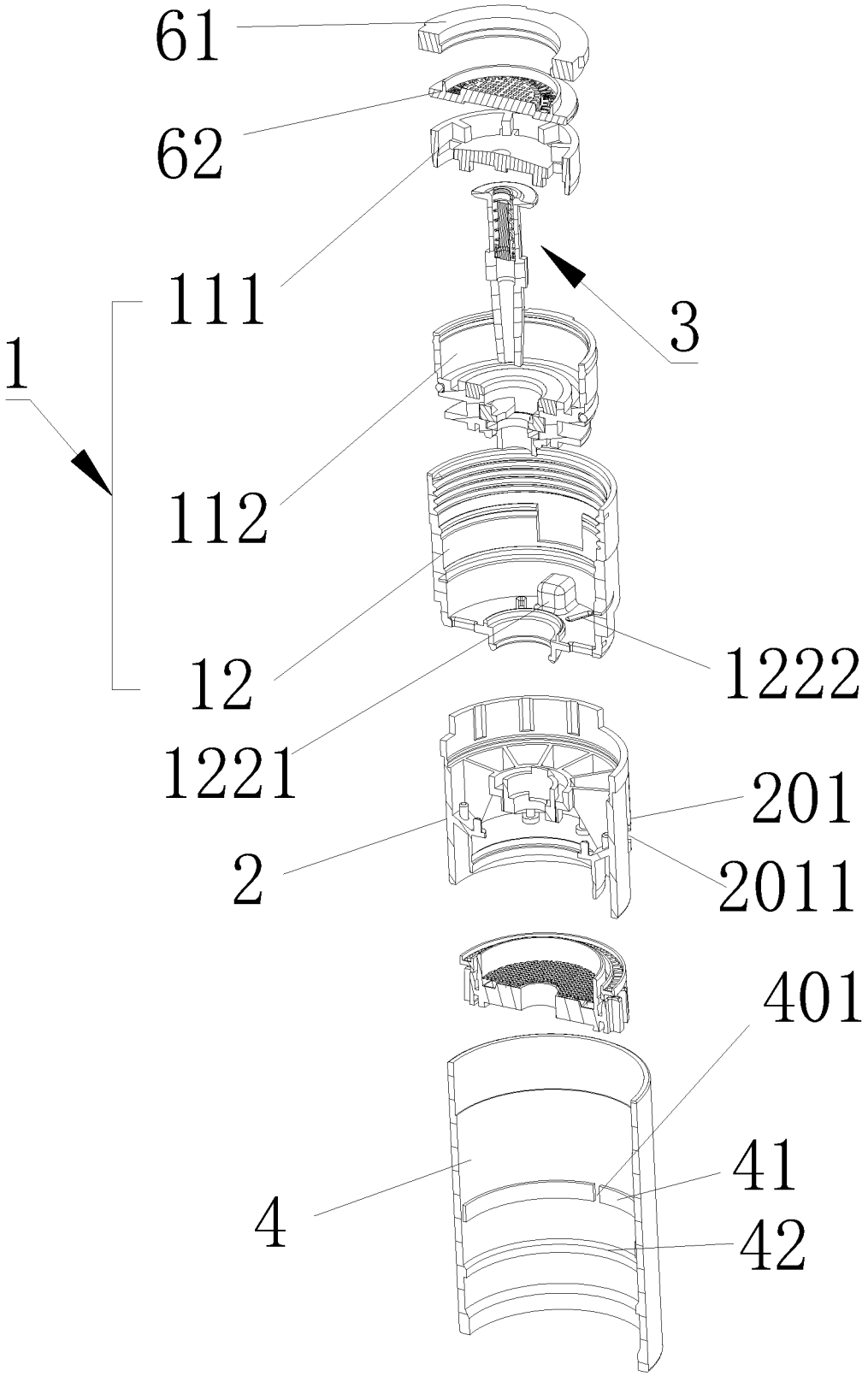
FIG. 7 is an exploded view of the water outlet device in Embodiment 1 of the Invention.

As shown in FIG. 5 and FIG. 6, the shell 4 is rotated to drive the guide mechanism 2 to rotate to enable the protrusion 31 abut against the second step surface 2112, at this moment, the top of the diversion body 33 abuts against the top of the inner side of the water inlet assembly 11, the first water outlet channel 20 is closed, and the water inlet channel 10 is sequentially communicated with the transitional passage 40 and the second water outlet channel 301. When water enters the second water outlet channel 301 from the transitional passage 40, air is sucked in via the air inlet gap 50 to form aerated water.

Embodiment 2 of the invention is as follows:

This embodiment differs from Embodiment 1 in that the specific structure of the water inlet assembly 11 is defined.

Referring to FIG. 2, the water inlet assembly 11 comprises an upper water inlet ring 111, a lower water inlet ring 112, a second washer 113, a third washer 114, a pressing buckle 115 and a fourth washer 116, the second washer 113 is embedded in the top of the lower water inlet ring 112, and the upper water inlet ring 111 is embedded in the top of the lower water inlet ring 112; the pressing buckle 115 is horizontally inserted into a water outlet of the lower water inlet ring 112, and the third washer 114 is embedded in the lower water inlet ring 112 and is located below the pressing buckle 115; the water outlet assembly 12 is disposed around the outer side of the lower water inlet ring 112; the fourth washer 116 is disposed around the outer side of the lower water inlet ring 112 and is located inside the water outlet assembly 12; and upper ends of two protrusions 31 are clamped in the lower end of the lower water inlet ring 112 to fix the diversion body 33.

In this embodiment, by adoption of the third washer 114, water is prevented from flowing through a gap between the diversion body 33 and the lower water inlet ring 112, which may otherwise decrease the water pressure when shower water and aerated water are formed and affect the outlet state of the shower water and the aerated water; and the pressing buckle 115 can prevent the third washer 114 from floating upwards, which may otherwise block the water outlet of the lower water inlet ring 112, so that it is ensured that water can flow through the gap between the pressing buckle 115 and the lower water inlet ring 112.

Embodiment 3 of the invention is as follows:

This embodiment differs from Embodiment 2 in that a second structure of the guide mechanism 2 and the diversion mechanism 3 is defined.

As show in FIG. 9-FIG. 12, a second annular boss 36 is arranged outside the diversion mechanism 3, and a trapezoidal groove 361 is formed in the lower side of the second annular boss 36 to form two step surfaces at different heights, that is, a first step surface 3611 and a second step surface 3612; the first step surface 3611 is located at the bottom of the second annular boss 36, and the second step surface 3612 is located at the top of the trapezoidal groove 361. The top width of the trapezoidal groove 361 in the rotation direction is smaller than the bottom width of the trapezoidal groove 361 in the rotation direction. Two protrusions 31 are oppositely arranged on the outer side of the diversion mechanism 3 and are inserted into the lower end of the lower water inlet ring 112 to limit the movement of the diversion mechanism 3, so that the positional relation between the diversion mechanism 3 and the lower water inlet ring 112 is kept stable, and it is further ensured that the guide mechanism 2 can always rotate with respect to the water inlet mechanism 1.

Figure 12:
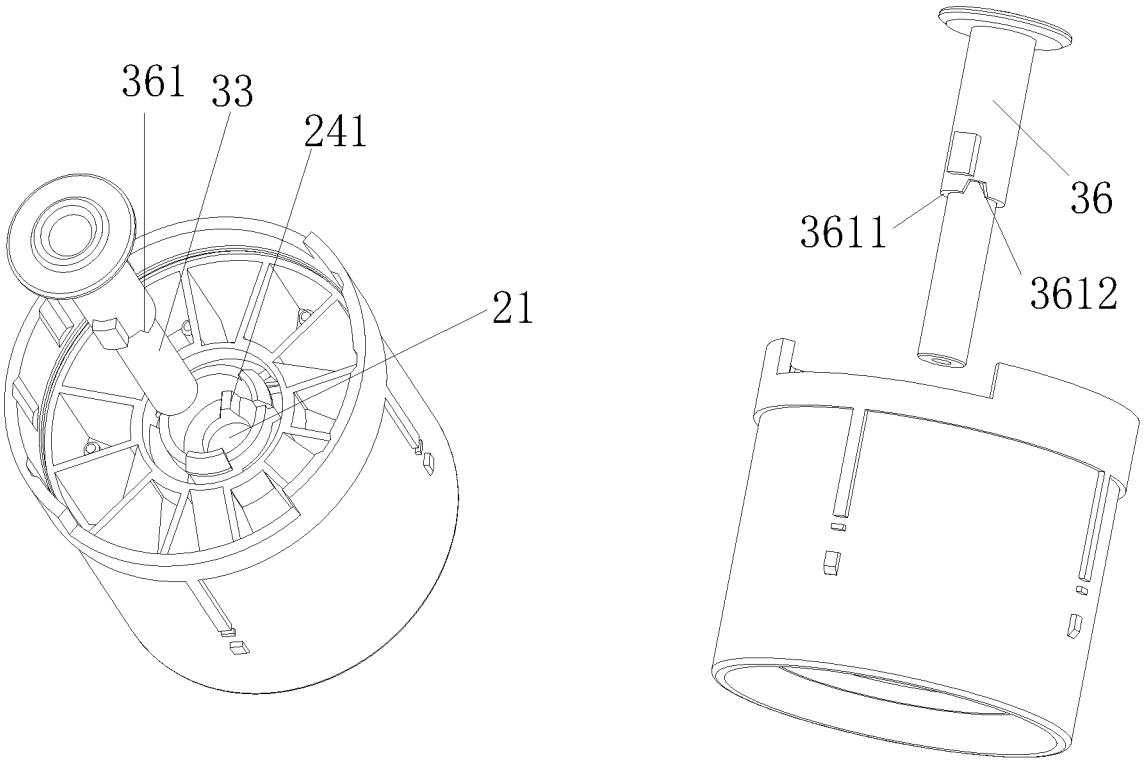
FIG. 12 is a structural view of a guide mechanism in Embodiment 3 of the invention.

Referring to FIG. 12, at least two clamping steps 24 to be inlaid in the trapezoidal groove 361 are disposed on the mounting hole 21 of the guide mechanism 2.

Figure 9:
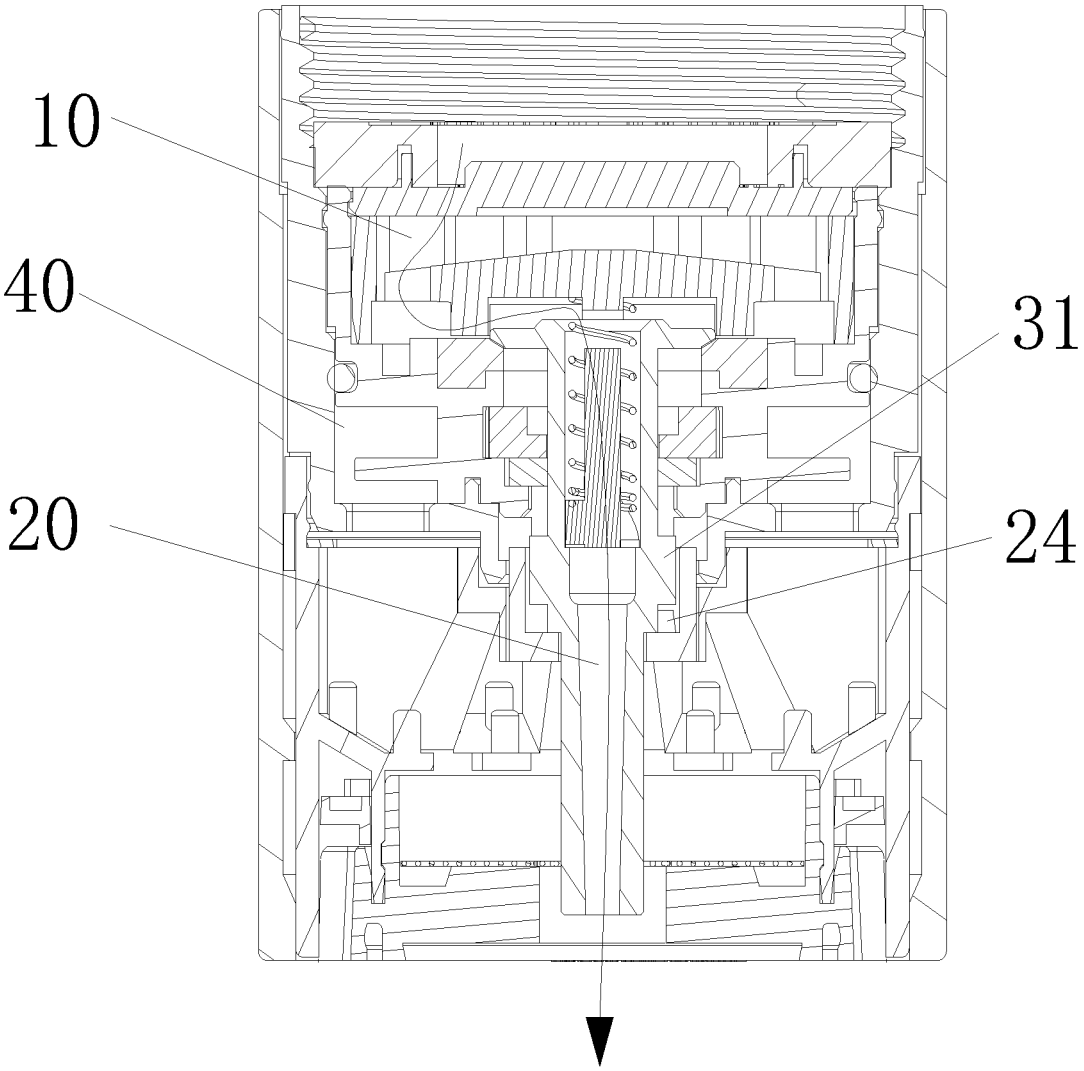
FIG. 9 is a sectional view of a water outlet device capable of discharging water mist in Embodiment 1 of the invention.

The specific implementation process of the invention is as follows:

Referring to FIG. 9 and FIG. 12, when the clamping steps 24 abut against the second step surface 3612, the bottom of the barrier 32 abuts against the water inlet of the lower water inlet ring 112, the transitional passage 40 is closed, the water inlet channel 10 is communicated with the first water outlet channel 20, and water mist or column water in other forms can be formed according to the actual function of the functional part 35. In this embodiment, the functional part 35 can form water mist.

Figure 10:
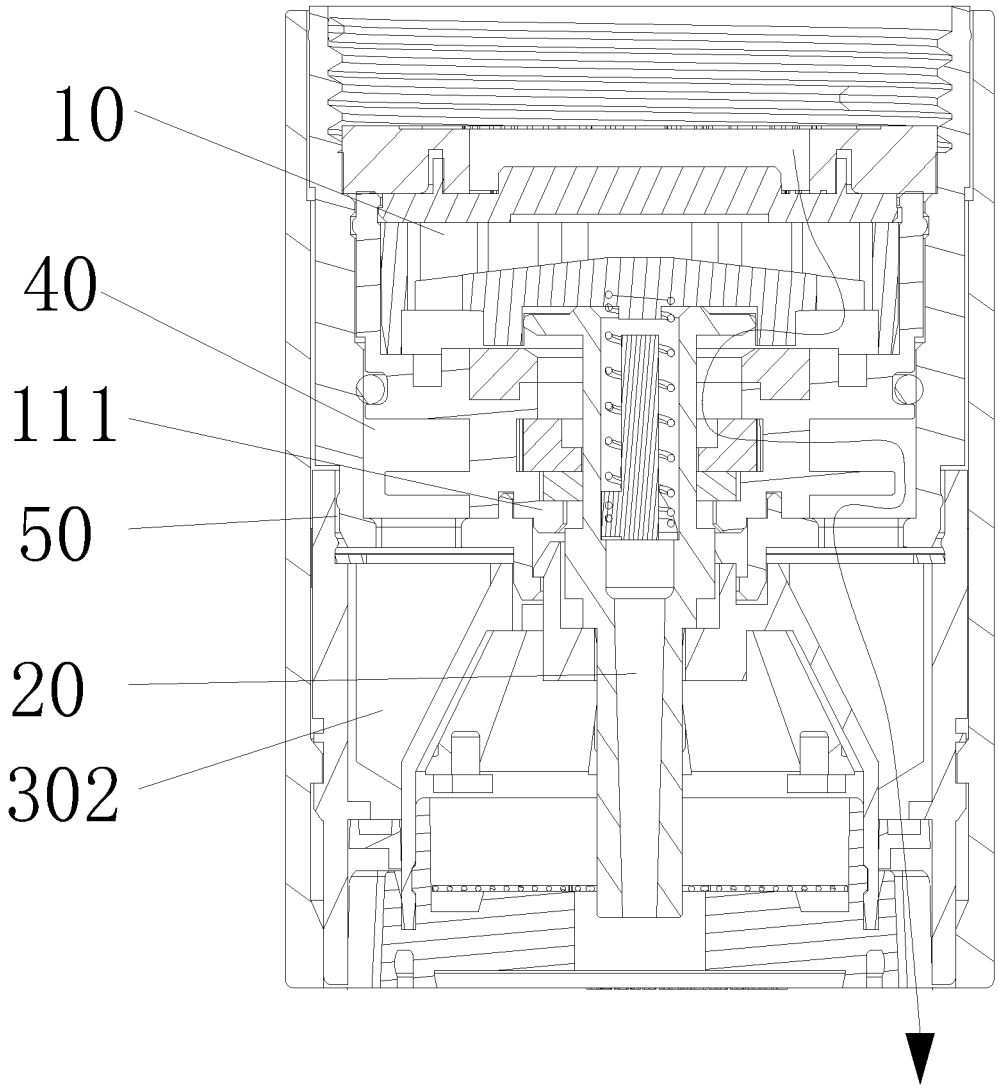
FIG. 10 is a sectional view of the water outlet device capable of discharging shower water in Embodiment 3 of the invention.

Referring to FIG. 10, the shell 4 is rotated to drive the guide mechanism 2 to rotate, the clamping steps 24 abut against the second step surface 2112, at this moment, the top of the diversion body 33 abuts against the lower side of the upper water inlet ring 111, the first water outlet channel 20 is closed, and the water inlet channel 10 is sequentially communicated with the transitional passage 40 and the third water outlet channel 302 to discharge shower water.

Figure 11:
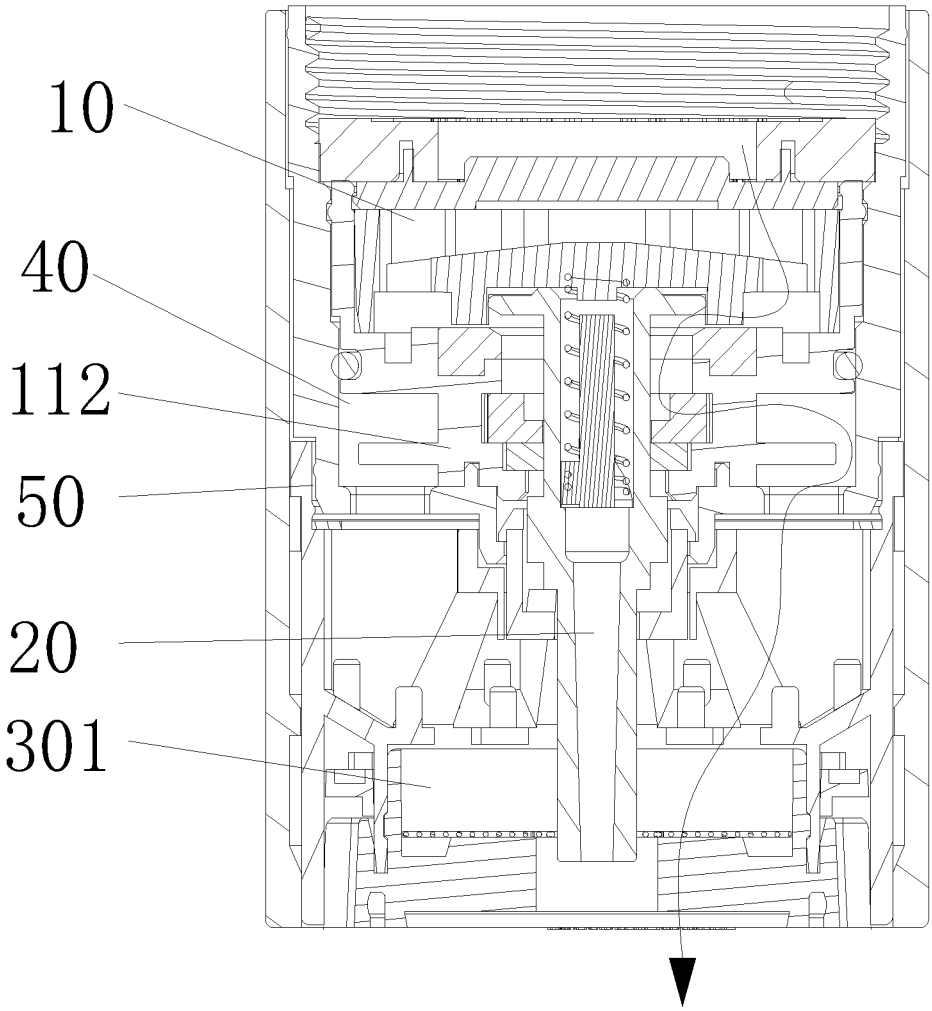
FIG. 11 is a sectional view of the water outlet device capable of discharging aerated water in Embodiment 3 of the invention.

Referring to FIG. 11, the shell 4 is rotated to drive the guide mechanism 2 to rotate to enable the clamping steps 24 to abut against the first step surface 3611, at this moment, the top of the diversion body 33 the lower side of the water inlet ring 111, the first water outlet channel 20 is closed, and the water inlet channel 10 is communicated with the transitional passage 40 and the second water outlet channel 301; and when water enters the second water outlet channel 301 from the transitional passage 40, air is sucked in via the air inlet gap 50 to form aerated water.

Embodiment 4 of the invention is as follows:

This embodiment is suitable for a kitchen faucet or bathroom faucet provided with an external thread or an internal thread.

This embodiment differs from Embodiment 2 in that another structure of the water outlet assembly 12 and the diversion mechanism 3 is defined.

Figure 13:
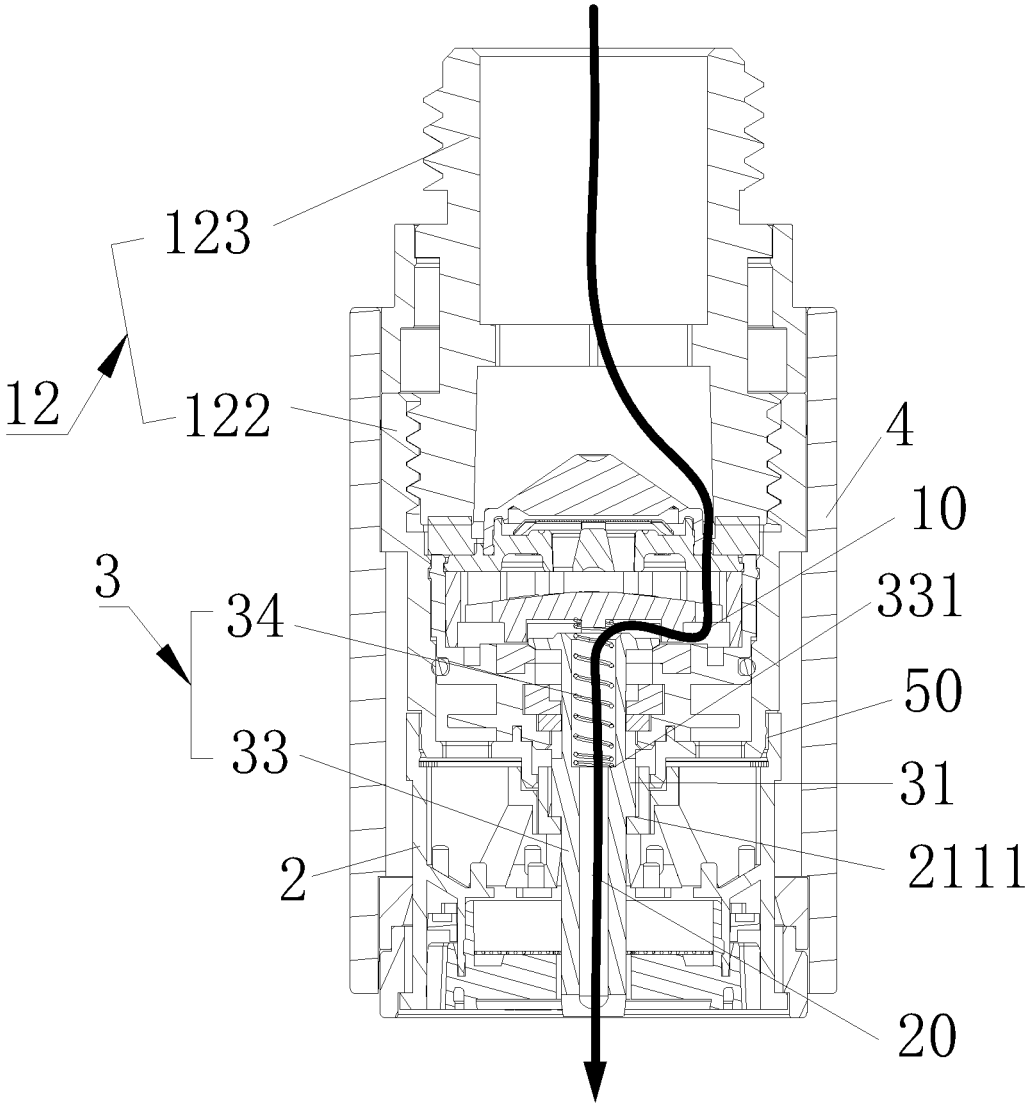
FIG. 13 is a sectional view of a water outlet device capable of discharging water mist in Embodiment 4 of the invention.

Referring to FIG. 13, the water outlet assembly 12 comprises a water outlet body 122 and an external threaded connecting piece 123, one end of the external threaded connecting piece 123 is connected to the water outlet body 122 in a threaded manner, and the other end of the external threaded connecting piece 123 is connected to a faucet provided with an internal thread.

Referring to FIG. 13, the diversion mechanism 3 comprises a diversion body 33 and a reset member 34, the reset member 34 is a compression spring; a first annular step 331 is arranged in the diversion body 33, the lower end of the reset member 34 abuts against the first annular step 331, a triangular groove 333 in a triangular prism shape is formed in the bottom of the diversion body 33, the water outlet of the diversion body 33 is elliptic when looked down and is used to turn water flowing out of the diversion body 33 into blade water, which has higher impact force and can be used for washing gaps.

In this embodiment, after the external threaded connecting piece 123 is dissembled, the water outlet body 122 can be directly connected to a faucet provided with an external thread; and when the external threaded connecting piece 123 is assembled on the water outlet body 122, the water outlet body 122 can be connected to a faucet provided with an internal thread. So, the universality is higher.

The specific implementation process of this embodiment is as follows:

Referring to FIG. 13, when the protrusion 31 abuts against the first step surface 2111, the bottom of the barrier 32 abuts against the water inlet of the lower water inlet ring 112, the transitional passage 40 is closed, the water inlet channel 10 is communicated with the first water outlet channel 20, and water flows out via the water outlet of the diversion body 33 to form blade water.

Figure 14:
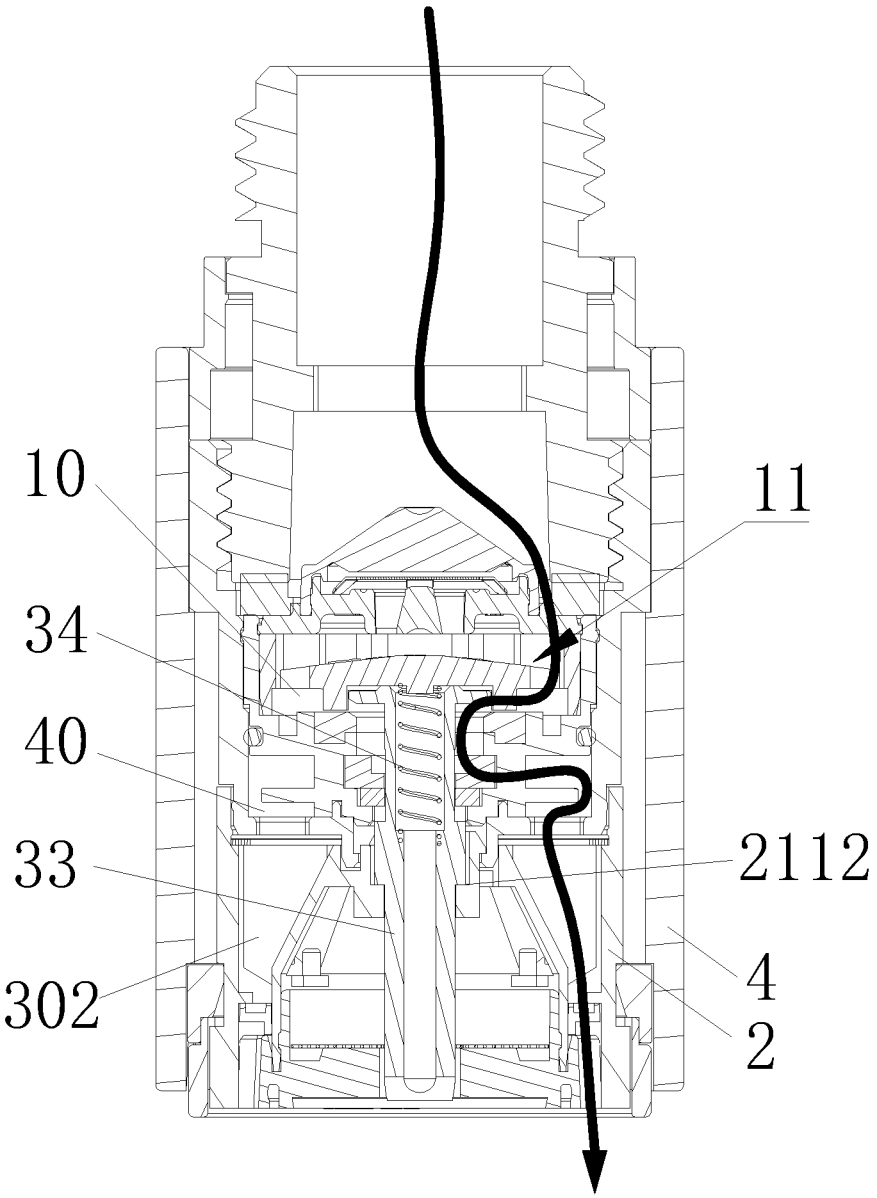
FIG. 14 is a sectional view of the water outlet device capable of discharging shower water in Embodiment 4 of the invention.

Referring to FIG. 14, the shell 4 is rotated to drive the guide mechanism 2 to rotate to enable the protrusion 31 to abut against the second step surface 2112, at this moment, the top of the diversion body 33 abuts against the lower side of the upper water inlet ring 111, the first water outlet channel 20 is closed, and the water inlet channel 10 is communicated with the transitional passage 40 and the third water outlet channel 302 to discharge shower water.

Figure 15:
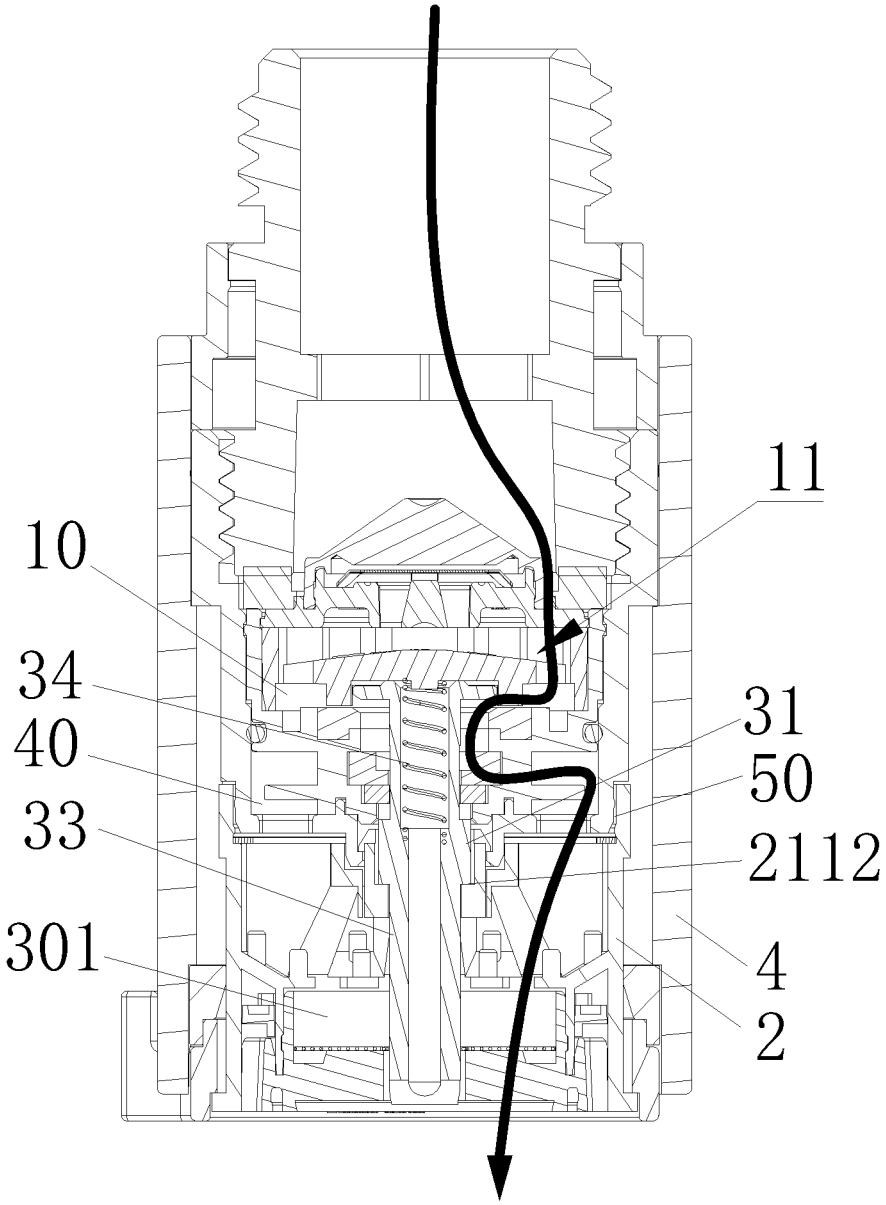
FIG. 15 is a sectional view of a water outlet device capable of discharging aerated water in Embodiment 5 of the invention.

Referring to FIG. 15, the shell 4 is rotated to drive the guide mechanism 2 to rotate to enable the protrusion 31 to abut against the second step surfaces 2112, at this moment, the top of the diversion body 33 abuts against the lower side of the upper water inlet ring 111, the first water outlet channel 20 is closed, and the water inlet channel 10 is sequentially communicated with the transitional passage 40 and the second water outlet channel 301. When water enters the second water outlet channel 301 from the transitional passage 40, air is sucked in via the air inlet gap 50 to form aerated water.

Embodiment 5 of the invention is as follows:

This embodiment is suitable for a shower provided with an internal thread.

This embodiment differs from Embodiment 4 in that another structure of the water outlet body 122 is defined.

Figure 16:
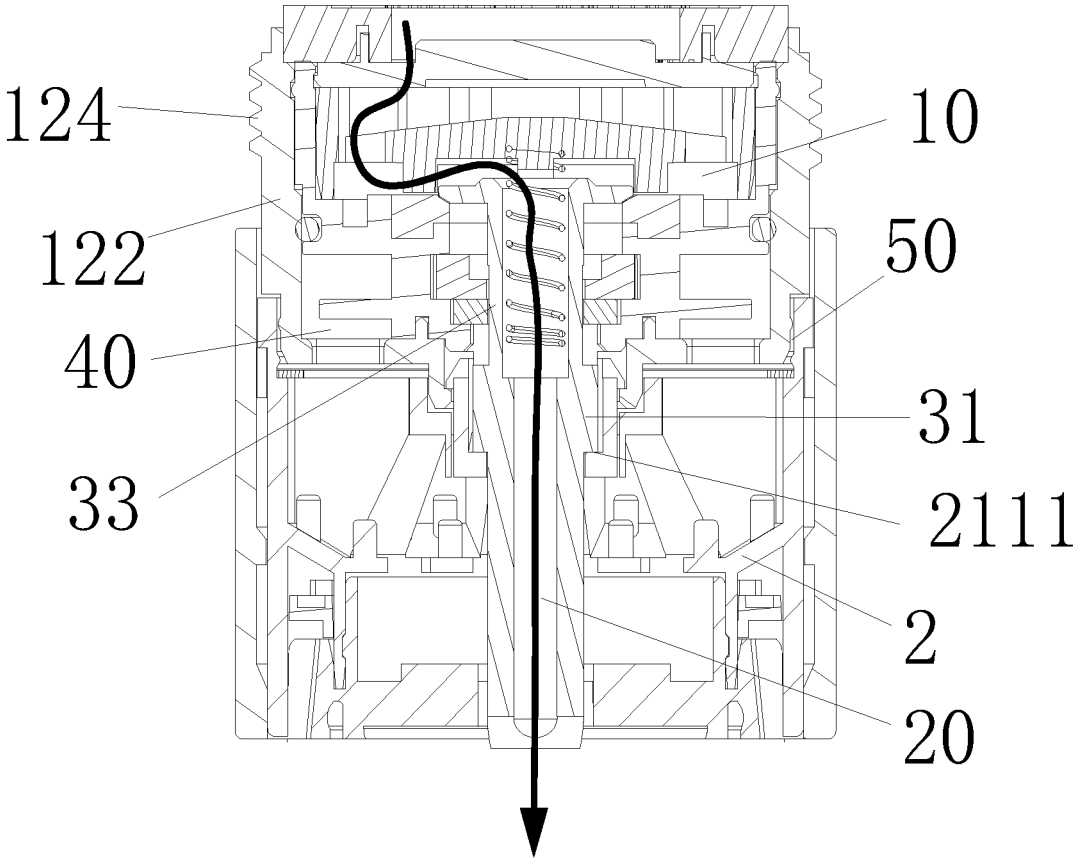
FIG. 16 is a sectional view of the water outlet device capable of discharging blade water in Embodiment 5 of the invention.
Figure 17:
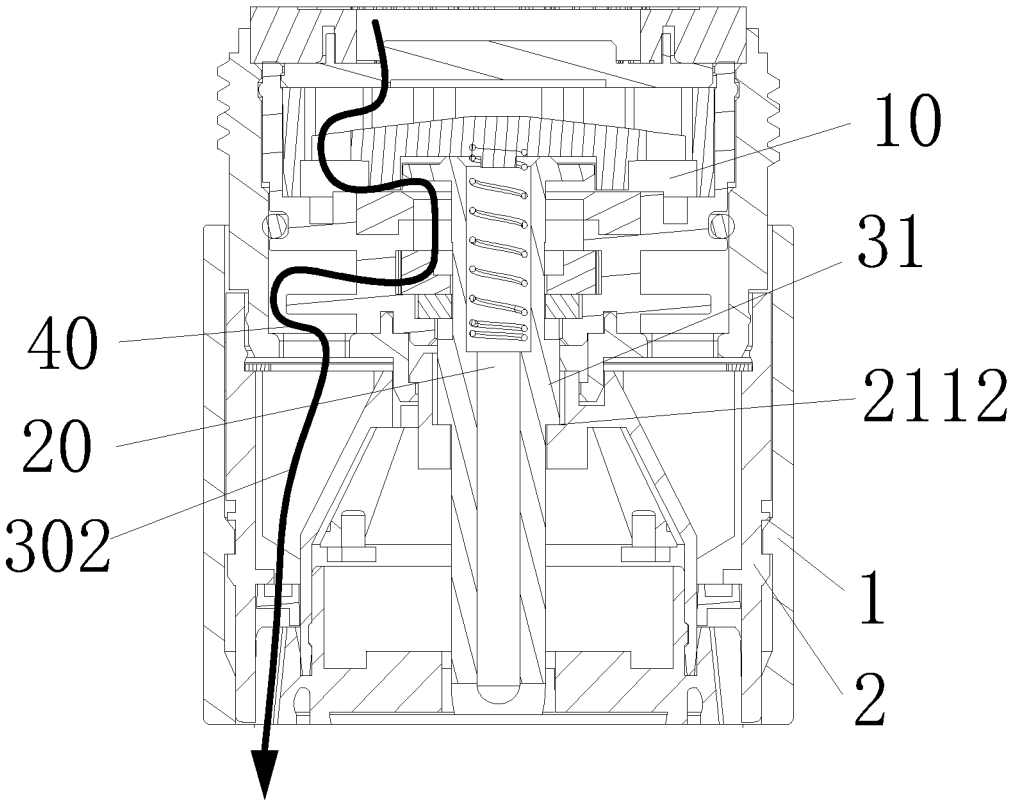
FIG. 17 is a sectional view of the water outlet device capable of discharging shower water in Embodiment 5 of the invention.
Figure 18:
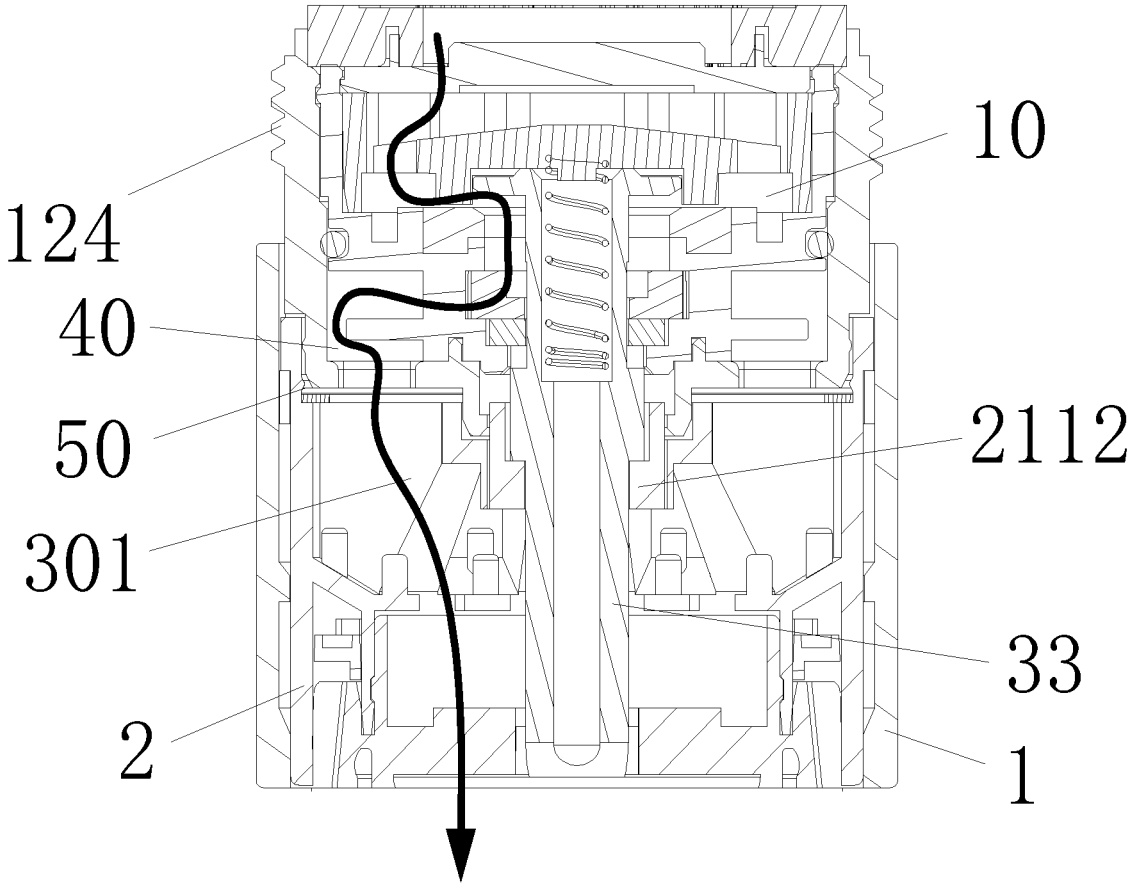
FIG. 18 is a sectional view of the water outlet device capable of discharging aerated water in Embodiment 5 of the invention.
Figure 19:
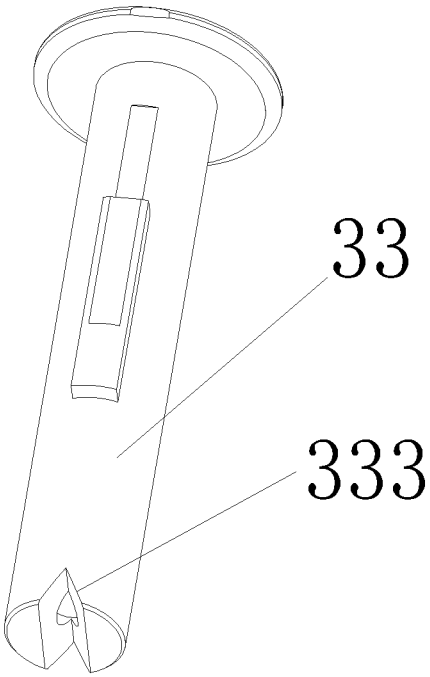
FIG. 19 is a structural view of a diversion body in Embodiment 5 of the invention.

Referring to FIG. 16-FIG. 18, an external thread 124 is arranged on the outer wall of the water outlet body 122 to connect the water outlet assembly 12 to a shower provided with an internal thread in a threaded manner.

The specific implementation process of this embodiment is as follows:

Referring to FIG. 16, when the protrusion 31 abuts against the first step surface 2111, the bottom of the barrier 32 abuts against the water inlet of the lower water inlet ring 112, the transitional passage 40 is closed, the water inlet channel 10 is communicated with the first water outlet channel 20, and water flows out via the water outlet of the diversion body 33 to form blade water.

Referring to FIG. 17, the shell 4 is rotated to drive the guide mechanism 2 to rotate to enable the protrusion 31 to abut against the second step surface 2112, at this moment, the top of the diversion body 33 abuts against the lower side of the upper water inlet ring 111, the first water outlet channel 20 is closed, and the water inlet channel 10 is communicated with the transitional passage 40 and the third water outlet channel 302 to form shower water.

Referring to FIG. 18, the shell 4 is rotated to drive the guide mechanism 2 to rotate to enable the protrusion 31 to abut against the second step surface 2112, at this moment, the top of the diversion body 33 abuts against the lower side of the upper water inlet ring 111, the first water outlet channel 20 is closed, and the water inlet channel 10 is sequentially communicated with the transitional passage 40 and the second water outlet channel 301. When water enters the second water outlet channel 301 from the transitional passage 40, air is sucked in via the air inlet gap 50 to form aerated water.

Embodiment 6 of the invention is as follows:

This embodiment differs from Embodiment 1 in that a third structure of the guide mechanism 2 is defined.

Referring to FIG. 20 to FIG. 23, the guide mechanism 2 and the diversion mechanism 3 can simultaneously move with respect to the water inlet mechanism 1. When the guide mechanism 2 and the diversion mechanism 3 move with respect to the water inlet mechanism 1, the water inlet channel 10 is communicated with the first water outlet channel 20, the second water outlet channel 301 or the third water outlet channel 302.

Referring to FIG. 23, a mounting hole 21 is formed in the guide mechanism 2, a step 211 is disposed on the mounting hole 21, and the diversion mechanism 3 penetrates through the mounting hole 21 and rotatably abuts against the step 211.

Preferably, two steps 211 are symmetrically disposed on the mounting hole 21.

Specifically, the step 211 is composed of a first step surface 2111, a second step surface 2112 and a third step surface 2113, the first step surface 2111, the second step surface 2112 and the third step 2113 are sequentially arranged in an encircling manner from bottom to top; the first step surface 2111 is connected to the second step surface 2112 through a transitional slope, and the second step surface 2112 is connected to the third step surface 2113 through a transitional slope.

Figure 20:
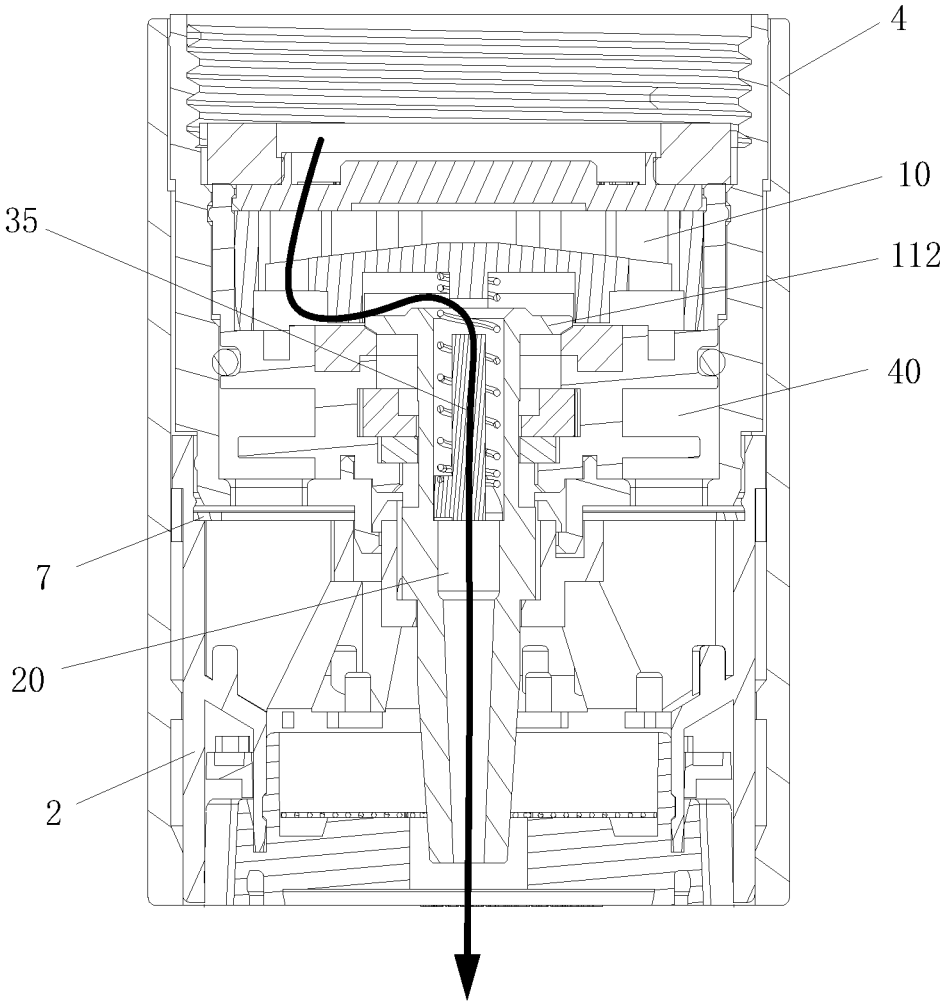
FIG. 20 is a sectional view of a water outlet device capable of discharging blade water in Embodiment 6 of the invention.

The specific implementation process of this embodiment is as follows:

Referring to FIG. 20, when the protrusion 31 abuts against the first step surface 2111, the bottom of the barrier 32 abuts against the water inlet of the lower water inlet ring 112, the transitional passage 40 is closed, and the water inlet channel 10 is communicated with the first water outlet channel 20. Water mist or columnar water in other forms can be formed according to the actual function of the functional part 35. In this embodiment, the functional part 35 can form water mist.

Figure 21:
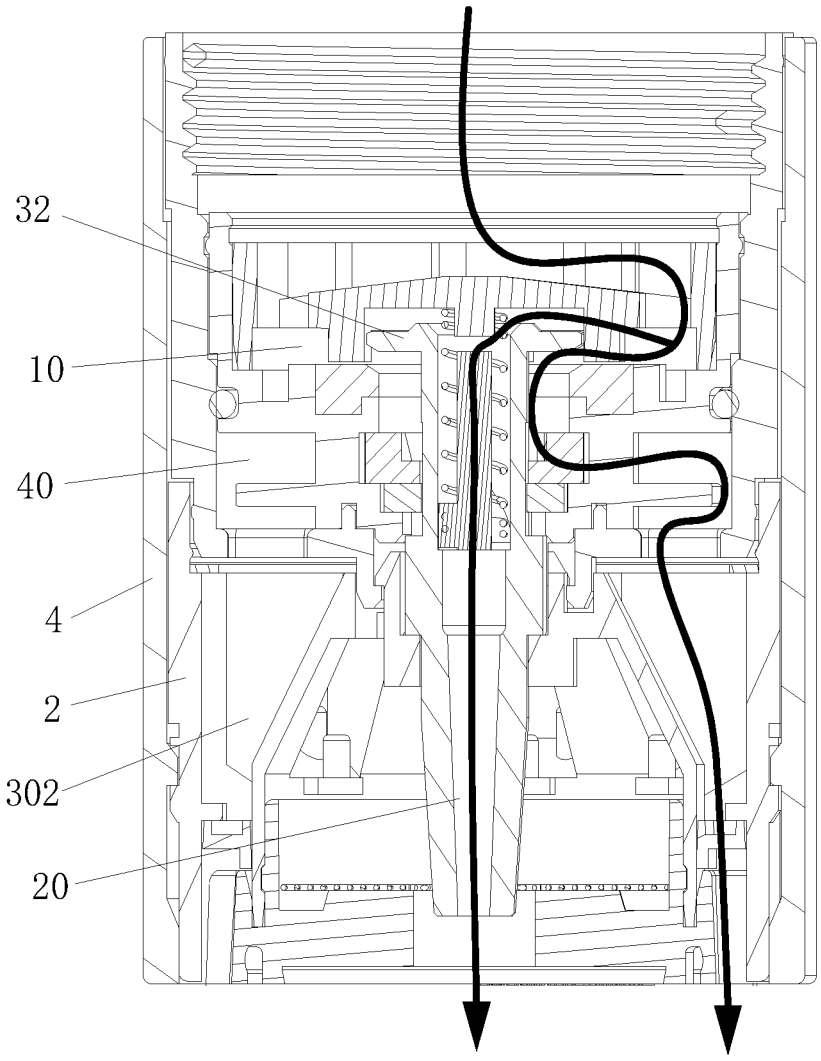
FIG. 21 is sectional view of the water outlet device capable of discharging shower water in Embodiment 6 of the invention.
Figure 22:
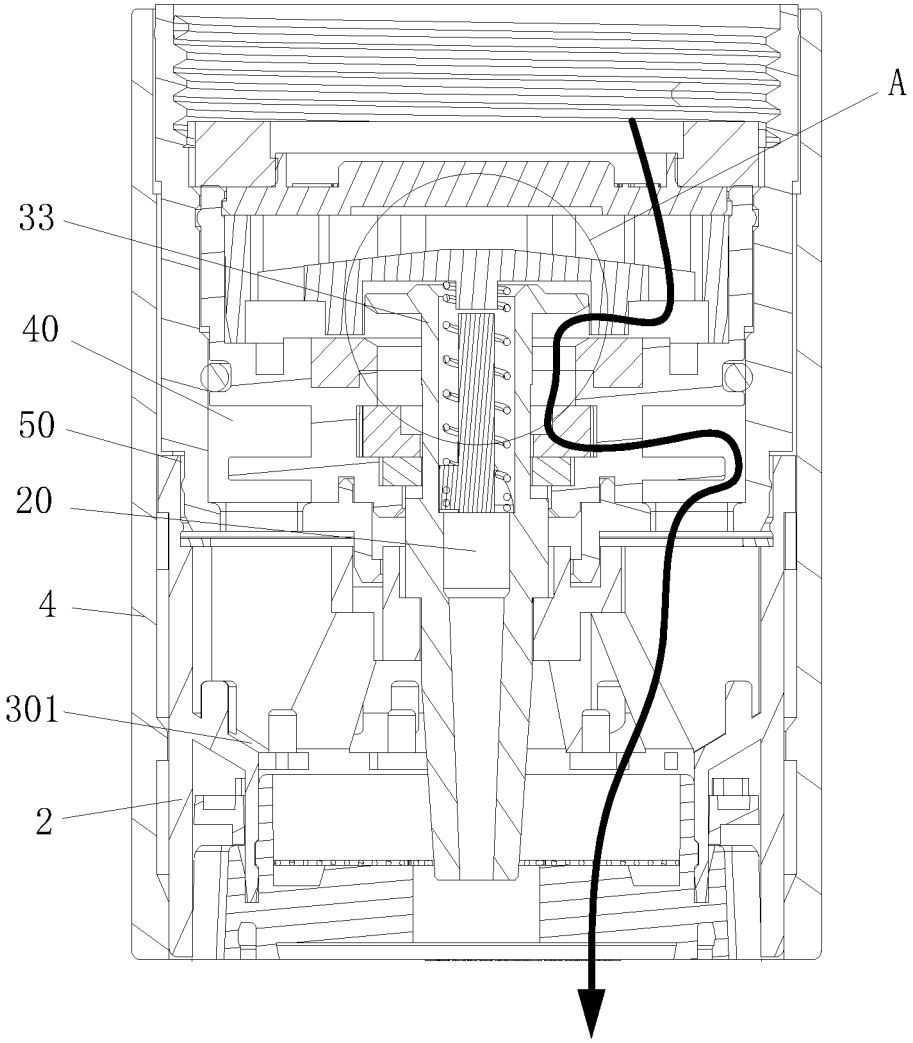
FIG. 22 is a sectional view of the water outlet device capable of discharging aerated water in Embodiment 6 of the invention.

Referring to FIG. 21, the shell 4 is rotated to drive the guide mechanism 2 to rotate to enable the protrusion 31 to abut against the second step 2112, at this moment, the top of the barrier 32 abuts against a side, facing the diversion body 33, of the upper water inlet ring 111, the first water outlet channel 20 is closed, the water inlet channel 10 is communicated with the first water outlet channel 20 and the transitional passage 40, and the transitional passage 40 is communicated with the third water outlet channel 302 to form shower water;

Referring to FIG. 22, the shell 4 is rotated to drive the guide mechanism 2 to rotate to enable the protrusion 31 to abut against the third step surface 2113, at this moment, the distance a from the top of the diversion body 33 to the first annular boss 37 is 0 mm-0.1 mm, and the water inlet channel 10 is sequentially communicated with the transitional passage 40 and the second water outlet channel 301 and is also communicated with the first water outlet channel 20. When water flows into the second water outlet channel 301 from the transitional passage 40, air is sucked in via the air inlet gap 50 to form aerated water.

Embodiment 7 of the invention is as follows:

This embodiment differs from Embodiment 1 in that another structure of the guide mechanism 2 and the diversion mechanism 3 is defined.

Referring to FIG. 25-FIG. 29, when the guide mechanism 2 moves with respect to the water inlet mechanism 1, the water inlet channel 10 is communicated with the first water outlet channel 20 or the second water outlet channel 301, or is communicated with the first water outlet channel 20 and the third water outlet channel 302.

Referring to FIG. 19 and FIG. 25-FIG. 29, the diversion mechanism 3 comprises a diversion body 33 and a reset member 34, and the reset member 34 is a compression spring; the upper end of the reset member 34 penetrates through two protrusions 31, and the lower end of the reset member 34 is disposed around the diversion body 33 and abuts against the guide mechanism 2 to push the diversion body 33 to reset; two steps 211 are oppositely arranged at the top of the diversion body 33, the section of each of the steps 211 is in an isosceles trapezoid shape, two step grooves 1111 which are opposite to each other and are matched with the steps 211 are formed in a side, facing the diversion body 33, of the upper water inlet ring 111, and side walls, in the rotation direction of the diversion body 33, of the step grooves 1111 are slopes for driving the steps 211 to rotate along the step grooves 1111 in the rotation direction, so that the diversion body 33 is driven to move vertically. A groove in a triangular prism shape is formed in the bottom of the diversion body 33, and an outlet of the diversion body 33 is elliptical when looked down and is used to turn water flowing out of the diversion body 33 into blade water, which has higher impact force and can be used for washing gaps. In other equivalent embodiments, step surfaces which are smoothly connected in sequence from top to bottom may be arranged in the step grooves 1111 to communicate the water inlet channel 10 with the first water outlet channel 20 and the third water outlet channel 302.

Figure 28:
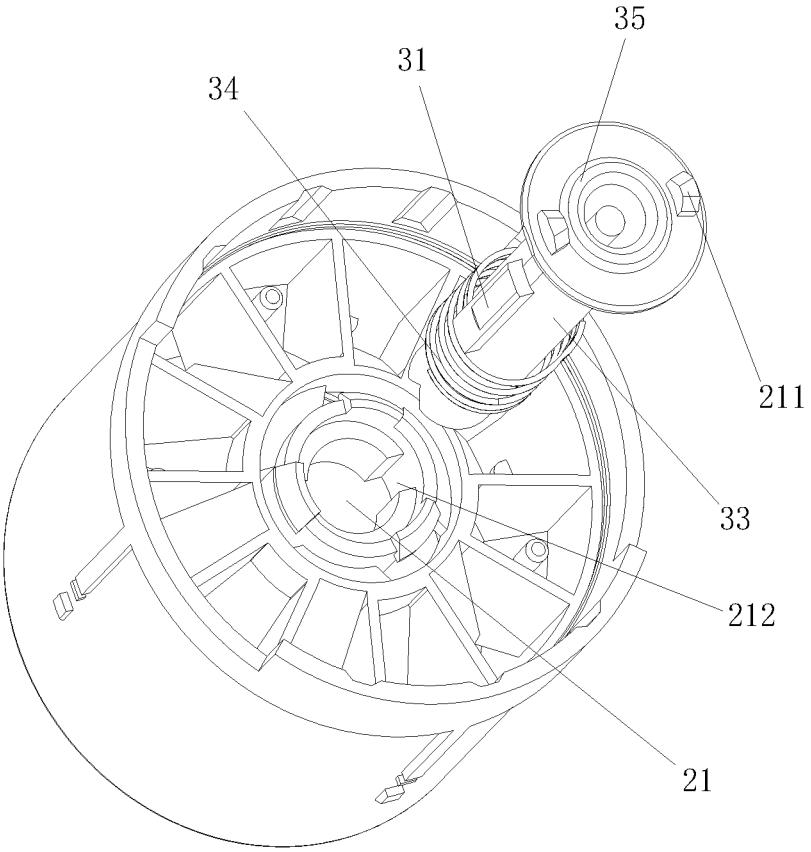
FIG. 28 is an exploded view of a guide mechanism and a diversion mechanism in Embodiment 7 of the invention.
Figure 29:
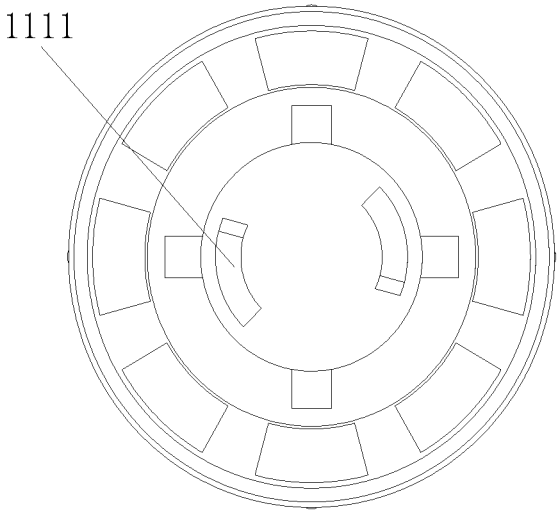
FIG. 29 is a bottom view of an upper water inlet ring in Embodiment 7 of the invention.

Referring to FIG. 28, through grooves 212 matched with the protrusions 31 are formed in the annular side wall of the mounting hole 21 of the guide mechanism 2, and the protrusions 31 penetrate through the through grooves 212, so that when the guide mechanism 2 rotates, the protrusions 31 drive the diversion body 33 to rotate through the protrusions 31 to realize switching of water outlet channels.

Figure 25:
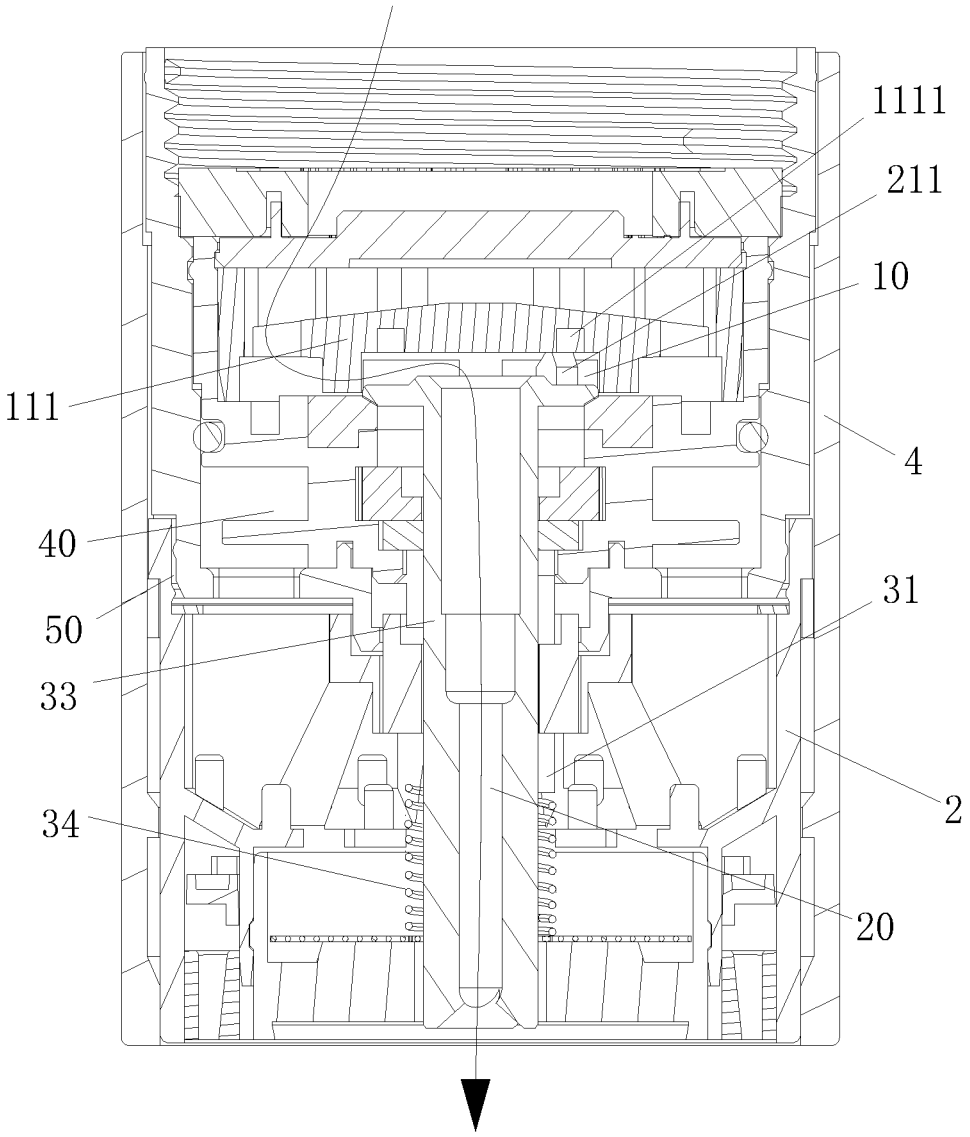
FIG. 25 is a sectional view of a water outlet device capable of discharging blade water in Embodiment 7 of the invention.

The specific implementation process of this embodiment is as follows:

Referring to FIG. 25, when the tops of the steps 211 are located outside the step grooves 1111 and abut against the lower side of the upper water inlet ring 111, the bottom of the barrier 32 abuts against the water inlet of the lower water inlet ring 112, the transitional passage 40 is closed, the water inlet channel 10 is communicated with the first water outlet channel 20, and water flows out via the water outlet of the diversion body 33 to form blade water.

Figure 26:
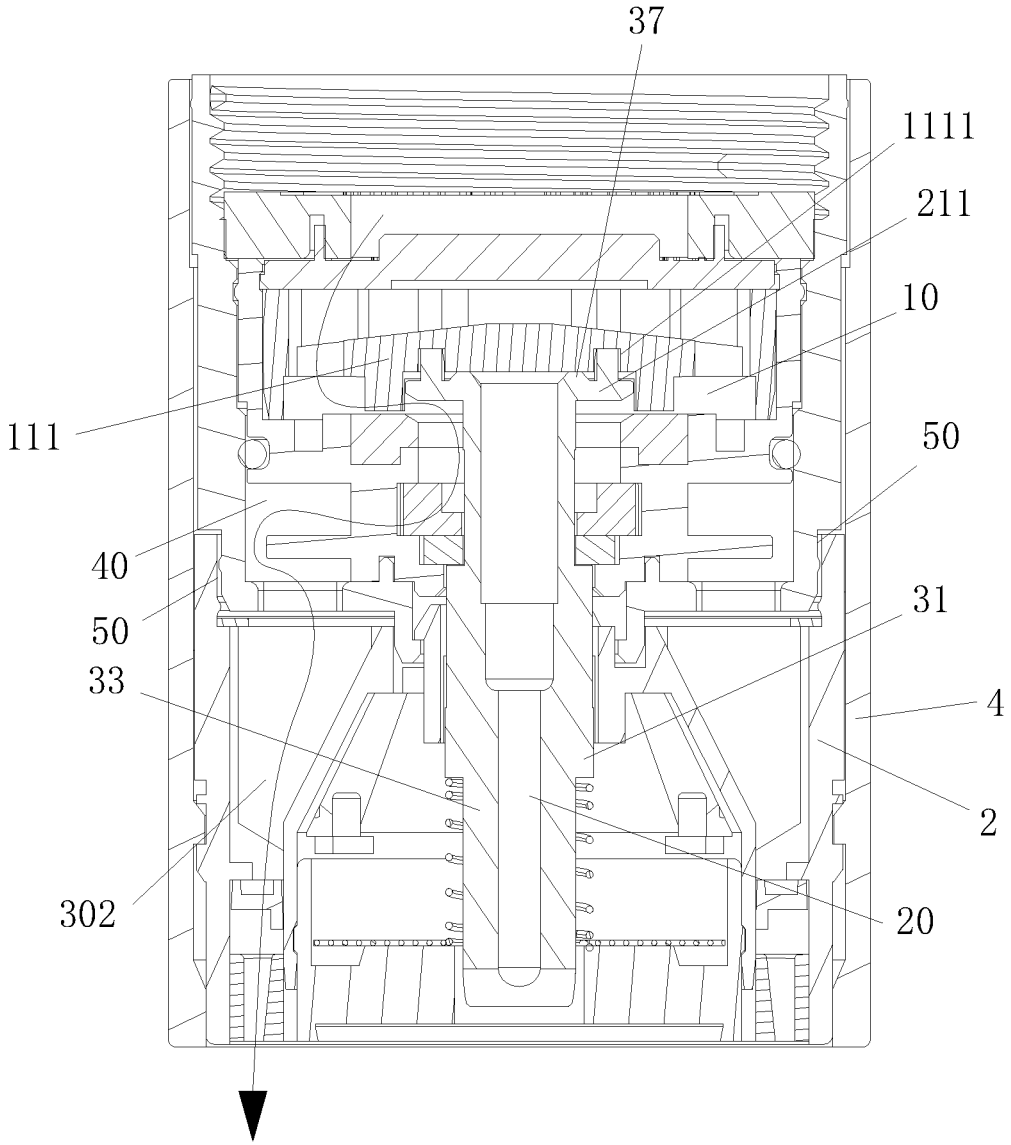
FIG. 26 is a sectional view of the water outlet device capable of discharging shower water in Embodiment 7 of the invention.

Referring to FIG. 26, the shell 4 is rotated to drive the guide mechanism 2 and the diversion body 33 to rotate to enable the protrusions 31 to be embedded in the step grooves 1111, at this moment, the top of the diversion body 33 abuts against the lower side of the upper water inlet ring 111, the first water outlet channel 20 is closed, and the water inlet channel 10 is consequentially communicated with the transitional passage 40 and the third water outlet channel 302 to form shower water.

Figure 27:
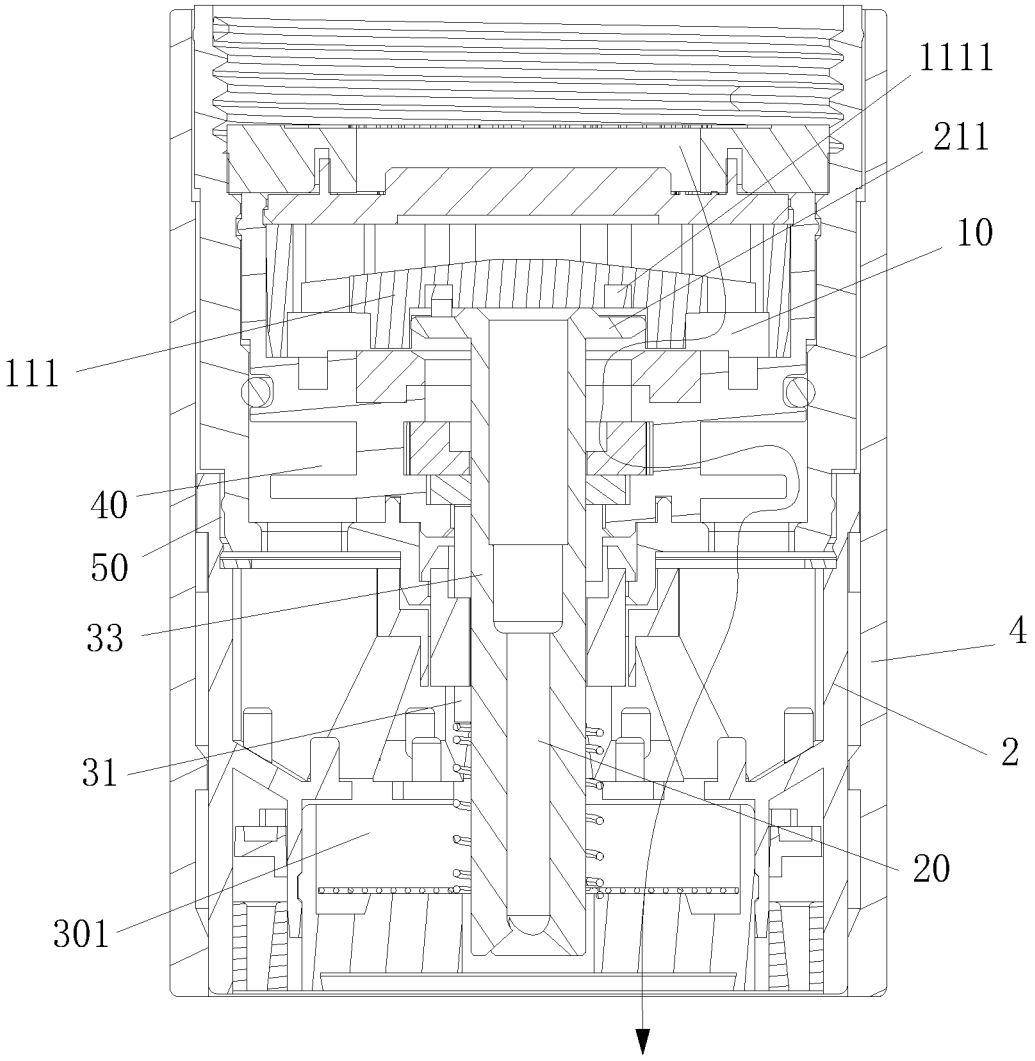
FIG. 27 is a sectional view of the water outlet device capable of discharging aerated water in Embodiment 7 of the invention.

Referring to FIG. 27, the shell 4 is rotated to drive the guide mechanism 2 and the diversion body 33 to rotate, the protrusions 31 are located in the step grooves 1111, at this moment, the top of the diversion body 33 abuts against the lower side of the upper water inlet ring 111, the first water outlet channel 20 is closed, and the water inlet channel 10 is communicated with the transitional passage 40 and the second water outlet channel 301. When water enters the second water outlet channel 301 from the transitional passage 40, air is sucked in via the air inlet gap 50 to form aerated water.

To sum up, according to the water outlet deice provided by the invention, the diversion body, the barrier and the protrusions are matched with the steps to shift three gears to realize switching of different water outlet channels to obtain three different types of functional water. The linking process is simple, switching of three different types of water can be realized by means of rotation, so that operation is easy, the water outlet manners of the bathroom water outlet products are enriched, different using requirements of users are met; and by arranging the diversion body, one type of functional water, namely water mist or blade water, is added without increasing the space to wash objects with the surface stained by stubborn dirt.

The above description is merely used to explain the embodiments of the invention, and is not intended to limit the patent scope of the invention. All equivalent transformations made according to the contents of the specification and accompanying drawings, or direct or indirect applications to relating technical fields should also fall within the patent protection scope of the invention.

What is claimed is:

1. A water outlet device, comprising a water inlet mechanism, a diversion mechanism, and a guide mechanism rotatably connected to the water inlet mechanism, wherein: the diversion mechanism is disposed in the water inlet mechanism, penetrates through an axis of the guide mechanism, and is moveable along a longitudinal direction of the axis, the diversion mechanism moves about a longitudinal axis; the water inlet mechanism comprises a water inlet channel; the diversion mechanism comprises a first water outlet channel; the guide mechanism comprises a second water outlet channel and a third water outlet channel; when the guide mechanism moves with respect to the diversion mechanism, the water inlet channel is communicated with the first water outlet channel, the second water outlet channel or the third water outlet channel;

wherein the water inlet mechanism comprises a water inlet assembly and a water outlet assembly; one end of the diversion mechanism is movably disposed in the water inlet assembly, and another end of the diversion mechanism movably penetrates through the water outlet assembly; a transitional passage for communicating the water inlet channel with the second water outlet channel is formed between the water inlet assembly and the water outlet assembly; and further comprising a shell, wherein: the shell is disposed outside the water outlet assembly and the guide mechanism; an air inlet gap is formed between the water outlet assembly and the shell; the air inlet gap is communicated with the second water outlet channel.

2. The water outlet device according to claim 1, wherein the guide mechanism and the diversion mechanism are able to move with respect to the water inlet mechanism;

when the guide mechanism and the diversion mechanism move with respect to the water inlet mechanism, the water inlet channel is communicated with the first water outlet channel, the second water outlet channel or the third water outlet channel.

3. The water outlet device according to claim 1, wherein when the guide mechanism moves with respect to the water inlet mechanism, the water inlet channel is communicated with the first water outlet channel or the second water outlet channel, or is communicated with the first water outlet channel and the third water outlet channel.

4. The water outlet device according to claim 2, wherein when the guide mechanism moves with respect to the water inlet mechanism, the water inlet channel is communicated with the first water outlet channel or the second water outlet channel, or is communicated with the first water outlet channel and the third water outlet channel.

5. The water outlet device according to claim 1, wherein the diversion mechanism comprises a water outlet, and when the guide mechanism rotates with respect to the diversion mechanism, the water inlet channel is communicated with the second water outlet channel or the third water outlet channel through the water outlet.

6. The water outlet device according to claim 1, wherein a mounting hole is formed in the guide mechanism;

a step is arranged on the mounting hole;

the diversion mechanism penetrates through the mounting hole and movably abuts against the step.

7. The water outlet device according to claim 6, wherein the step comprises a first step surface and a second step surface;

the first step surface is in transitional connection with the second step surface through a slope.

8. The water outlet device according to claim 6, wherein a protrusion is arranged at an end, located in the guide mechanism, of the diversion mechanism, and is able to move vertically along the step.

9. The water outlet device according to claim 8, wherein an upper end of the protrusion is inserted into the water inlet mechanism.

10. The water outlet device according to claim 1, wherein a barrier for blocking the second water outlet channel is arranged at an end, located in the water inlet mechanism, of the diversion mechanism.

11. The water outlet device according to claim 1, wherein the diversion mechanism comprises a diversion body and a reset member;

one end of the reset member is disposed in the diversion body, and another end of the reset member abuts against one side of the water inlet mechanism.

12. The water outlet device according to claim 11, wherein a functional part is disposed in the diversion body;

one end of the reset member abuts against the functional part, and another end of the reset member abuts against one side of the water inlet mechanism.

13. The water outlet device according to claim 1, wherein the guide mechanism is connected to the water outlet assembly in a buckled manner.

* * * * *